US010676257B2

(12) United States Patent
Girardot et al.

(10) Patent No.: US 10,676,257 B2
(45) Date of Patent: Jun. 9, 2020

(54) CONTAINER SYSTEMS WITH A SQUEEZE-AND-TURN CLOSURE

(71) Applicant: The Procter & Gamble Company, Cincinnati, OH (US)

(72) Inventors: Richard Michael Girardot, West Chester, OH (US); Nicole Lynn Briggs, West Chester, OH (US); Brian Joseph Sullivan, Milford, OH (US); Christopher Robert Kopulos, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 420 days.

(21) Appl. No.: 15/173,912

(22) Filed: Jun. 6, 2016

(65) Prior Publication Data

US 2017/0349341 A1 Dec. 7, 2017

(51) Int. Cl.

| | |
|---|---|
| ***B65D 50/04*** | (2006.01) |
| ***B65D 43/02*** | (2006.01) |
| ***B65D 47/12*** | (2006.01) |
| ***D06F 39/02*** | (2006.01) |
| ***B65B 1/04*** | (2006.01) |
| ***B65B 7/28*** | (2006.01) |

(52) U.S. Cl.

CPC ..... *B65D 50/043* (2013.01); *B65B 1/04* (2013.01); *B65B 7/2835* (2013.01); *B65D 43/0231* (2013.01); *B65D 47/12* (2013.01); *B65D 47/122* (2013.01); *B65D 50/046* (2013.01); *D06F 39/024* (2013.01); *B65D 2251/0015* (2013.01); *B65D 2251/0087* (2013.01); *B65D 2251/065* (2013.01); *B65D 2543/00435* (2013.01)

(58) Field of Classification Search

CPC .. B65D 47/12; B65D 43/0231; B65D 50/043; B65D 50/046; B65D 47/122; B65D 2543/00435; B65D 2251/0087; B65D 2251/065; B65D 2251/0015; B65B 1/04; B65B 7/2835; D06F 39/024

USPC ..... 215/317, 225, 224, 217, 201, 331

See application file for complete search history.

(56) References Cited

U.S. PATENT DOCUMENTS

| | | | | |
|---|---|---|---|---|
| 4,149,646 A | | 4/1979 | Julian | |
| 4,752,014 A | * | 6/1988 | House | B65D 50/046 215/216 |
| 4,948,002 A | | 8/1990 | Thornock | |
| 5,230,433 A | | 7/1993 | Hamilton et al. | |
| 5,377,858 A | * | 1/1995 | Morris, Sr. | B65D 21/064 206/506 |

(Continued)

FOREIGN PATENT DOCUMENTS

| | | |
|---|---|---|
| CA | 152318 | 11/2013 |
| WO | WO 2006/082842 | 8/2006 |
| WO | WO 2009/103947 A1 | 8/2009 |

OTHER PUBLICATIONS

PCT Search Report for Application No. PCT/US2017/036031, dated Jul. 27, 2017, 19 pages.

(Continued)

*Primary Examiner* — James N Smalley

(74) *Attorney, Agent, or Firm* — Gregory S. Darley-Emerson

(57) ABSTRACT

Container systems that include a squeeze-and-turn closure. Closure systems that include a squeeze-and-turn closure. Methods related to such systems.

20 Claims, 21 Drawing Sheets

(56) References Cited

U.S. PATENT DOCUMENTS

| | | | | |
|---|---|---|---|---|
| 5,603,421 | A | 2/1997 | Opresco | |
| 5,671,853 | A | 9/1997 | Herr | |
| 5,706,963 | A * | 1/1998 | Gargione | B65D 50/046 215/217 |
| 5,865,330 | A | 2/1999 | Buono | |
| 5,915,576 | A | 6/1999 | Robinson | |
| 5,927,526 | A | 7/1999 | Herr | |
| 6,036,036 | A | 3/2000 | Bilani et al. | |
| 6,112,921 | A | 9/2000 | Robinson | |
| 6,168,035 | B1 | 1/2001 | McLelland | |
| 6,357,615 | B1 | 3/2002 | Herr | |
| 7,641,064 | B2 | 1/2010 | Robinson | |
| 7,815,062 | B2 | 10/2010 | Suffa | |
| D637,912 | S | 5/2011 | Van Den Wouwer et al. | |
| 8,038,026 | B2 | 10/2011 | Auer et al. | |
| 8,051,999 | B2 | 11/2011 | Carmody et al. | |
| 8,079,483 | B2 | 12/2011 | Brozell et al. | |
| 8,087,539 | B2 | 1/2012 | Auer et al. | |
| 8,123,058 | B2 | 2/2012 | Brozell et al. | |
| D656,402 | S | 3/2012 | Kopulos et al. | |
| D660,156 | S | 5/2012 | Kopulos et al. | |
| D662,817 | S | 7/2012 | Andres et al. | |
| D662,818 | S | 7/2012 | Andres et al. | |
| 8,240,491 | B2 | 8/2012 | Beecroft et al. | |
| 8,651,304 | B2 | 2/2014 | Skillin | |
| 8,870,004 | B2 | 10/2014 | McCoy et al. | |
| 2008/0277367 | A1 | 11/2008 | Yeager | |
| 2010/0051572 | A1* | 3/2010 | Beecroft | B65D 50/048 215/216 |
| 2011/0036841 | A1* | 2/2011 | Hentzel | B65D 41/0471 220/293 |
| 2011/0204087 | A1* | 8/2011 | Kopulos | B65D 21/0219 220/810 |
| 2015/0175325 | A1 | 6/2015 | Martin | |
| 2017/0210521 | A1 | 7/2017 | Roy | |

OTHER PUBLICATIONS

U.S. Appl. No. 15/173,920, filed Jun. 6, 2016, Richard Michael Girardot, et al.

U.S. Appl. No. 29/590,001, filed Jan. 6, 2017, Nicole Lynn Briggs, et al.

U.S. Appl. No. 29/575,733, filed Aug. 29, 2016, Hilde Andriessen.

Images of Aleve bottle.

Images of Advil—bottle 1.

Images of Advil—bottle 2.

* cited by examiner

CONTAINER SYSTEMS WITH A SQUEEZE-AND-TURN CLOSURE

FIELD OF THE INVENTION

The present disclosure relates to container systems that include a squeeze-and-turn closure. The present disclosure also relates to closure systems that include a squeeze-and-turn closure. The present disclosure also relates to methods related to such systems.

BACKGROUND OF THE INVENTION

Container systems that require a plurality of motions to open, for example push-and-turn or squeeze-and-turn, are known in the art and are often used to contain small items, such as medicines. However, such container systems are often not suitable for containing contents of a larger size or that require dispensation of larger volumes, e.g., articles to be grasped by an adult human hand or materials intended to be scooped. For example, the mouth of the container may not be sized appropriately to enable a human hand or scoop to fit through the opening.

The opening of the container, however, cannot simply be made larger. A larger opening requires a larger squeeze-and-turn closure, the size of which is constrained by the need to accommodate the span of an adult human hand. If the closure is too big, a user will not be able to squeeze the closure effectively. The desire to keep the opening small enough to accommodate a hand, however, can limit a manufacturer's ability to quickly and/or efficiently fill the container with contents.

Additionally, manufacturers face other difficulties. It can be expensive to manufacture a variety of closure systems to fit the spectrum of shapes and sizes of available containers. Therefore, it would be economical to manufacture one closure system or part thereof that is compatible with a variety of containers.

There is a need for improved container systems to meet one or more of the above challenges. It is desirable for the container systems and closure systems to be effective, intuitive to the user, and adaptable to the needs of manufacturers.

SUMMARY OF THE INVENTION

The present disclosure relates to container systems 100 and closure systems 150 that include a squeeze-and-turn closure 400.

The present disclosure also relates to container systems 100 that include: a container body 200 that has walls 210, 211, 212, 213, 214 defining an interior volume 202, and a rim 220 defining a container opening 222 that allows access to the interior volume 202, where the container opening 222 has a major axis 224 of a first length; a shroud 300 that is configured to be connectably engageable with the container body 200, the shroud 300 comprising a shroud opening 340 that allows access to the interior volume 202 through the container opening 222 when said shroud 300 is engaged with said container body 200, wherein said shroud opening 340 has a major axis 342 of a second length, said second length being less than said first length; and a closure 400 that is configured to be rotatably connectably engageable with said shroud 300 to close said shroud opening 340 when said closure 400 is engaged with said shroud 300 in a closed position, said closure 400 comprising a top wall 410, an outer skirt 420 depending downwardly from said top wall 410 toward said shroud 300 when said closure 400 is in said closed position, said outer skirt 420 comprising a first push pad 430, wherein when said closure 400 is in said closed position, said closure 400 is prevented from being rotated in an opening direction until said first push pad 430 is pressed radially inward.

The present disclosure also relates to a method of filling a container system 100 with a composition 500, said method comprising the steps of: providing a container body 200, wherein said container body 200 comprises walls defining an interior volume 202, said container body 200 further comprising a rim 220 defining a container opening 222 that allows access to said interior volume 202, wherein said container opening 222 has a major axis 224 of a first length; providing a composition 500, preferably a composition 500 in the form of unitized dose articles 510, to said interior volume 202 of said container 200; providing a shroud 300 and closure 400 to said container body 200, wherein said shroud 300 is configured to be connectably engageable with said container body 200, said shroud 300 comprising a shroud opening 340 that allows access to said interior volume 202 through said container opening 222 when said shroud 300 is engaged with said container body 200, wherein said shroud opening 340 has a major axis 224 of a second length, said second length being less than said first length; and wherein said closure 400 is configured to be rotatably connectably engageable with said shroud 300 to close said shroud opening 340 when said closure 400 is engaged with said shroud 300 in a closed position, said closure 400 comprising a top wall 410, an outer skirt 420 depending downwardly from said top wall 410 toward said shroud 300 when said closure 400 is in said closed position, said outer skirt 420 comprising a first push pad 430, wherein when said closure 400 is in said closed position, said closure 400 is prevented from being rotated in an opening direction until said first push pad 430 is pressed radially inward.

The present disclosure also relates to a closure system 150 that includes: (a) a shroud 300 that is configured to be connectably engageable with a container body 200, said shroud 300 comprising a shroud opening 340 sized to be capable of receiving an adult human hand; and (b) a closure 400 that is configured to be rotatably connectably engageable with said shroud 300 to close said shroud opening 340 when said closure 400 is engaged with said shroud 300 in a closed position, said closure 400 comprising a top wall 410, an outer skirt 420 depending downwardly from said top wall 410 toward said shroud 300 when said closure 400 is in said closed position, said outer skirt 420 comprising a first push pad 430, wherein when said closure 400 is in said closed position, said closure 400 is prevented from being rotated in an opening direction until said first push pad 430 is pressed radially inward.

The present disclosure also relates to a container system 100 that includes: a container body 200 comprising bottom 210 and side walls 213, 214 defining an interior volume 202, a rim 220 defining a container opening 222 that allows access to said interior volume 202, wherein said container opening 222 is sized to be capable of receiving an adult human hand, and a first locking lug 350 and a second locking lug 360, said first and second locking lugs 350, 360 being located near the rim 314 and circumferentially spaced around a rotational axis RA; a closure 400 configured to be connectably engageable with said container body 200 to close said container opening 222 when said closure 400 is engaged with said container body 200 in a closed position, said closure 400 comprising a top wall 410, an outer skirt 420 depending downwardly from said top wall 410 toward said container body 200 when said closure 400 is in said closed position, said outer skirt 420 comprising a first push pad 430 and a second push pad 440 circumferentially spaced from said first push pad 430, a first locking tab 480 that engages said first locking lug 350 when said closure 400 in said closed position, a second locking tab 490 that engages said second locking lug 360 when said closure 400 in said closed position, wherein said engagement of said locking tabs 480, 490 with said locking lugs 350, 360 prevents rotation of said closure 400 in said opening direction, and wherein pressing said push pads 430, 440 radially inward causes said locking tabs 480, 490 to disengage from said locking lugs 350, 360, allowing said closure 400 to be rotated in said opening direction; and soluble unit dose articles 510, said articles comprising a water-soluble film that encapsulates a composition 500, preferably a household care composition, in at least one compartment.

BRIEF DESCRIPTION OF THE DRAWINGS

The figures herein are illustrative in nature and are not intended to be limiting.

DETAILED DESCRIPTION OF THE INVENTION

As described above, squeeze-and-turn closures must be small enough to be accommodating to a user's hand, but the resulting small opening makes filling the container efficiently a challenge, particularly when the contents are larger-sized articles.

Figure 1:
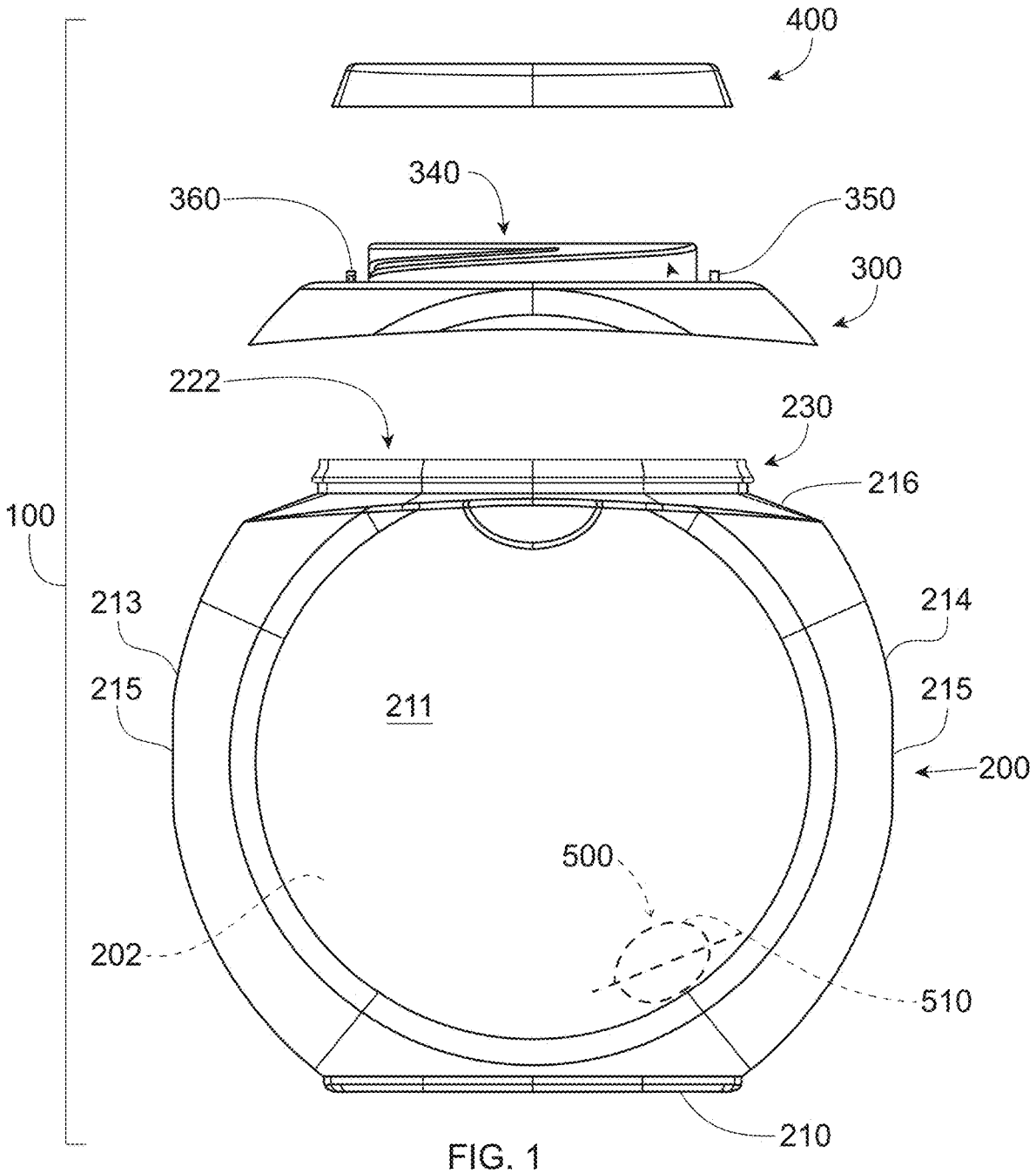
FIG. 1 shows a container system according to the present disclosure.

The container systems 100 of the present disclosure solve this problem of finding balance by providing a three-piece container system. As seen in FIG. 1, the container systems 100 of the present disclosure may include a container body 200, a shroud 300, and a closure 400. In short, the container body 200 has an opening that is relatively larger than the opening of the shroud 300. The larger opening of the container body 200 allows for more efficient filling. The smaller opening of the shroud 300 may be large enough to allow access by an adult human hand to the interior volume 202 of the container body 200, but yet small enough to receive a squeeze-and-turn closure 400 that can be easily operated by a user.

Figure 2:
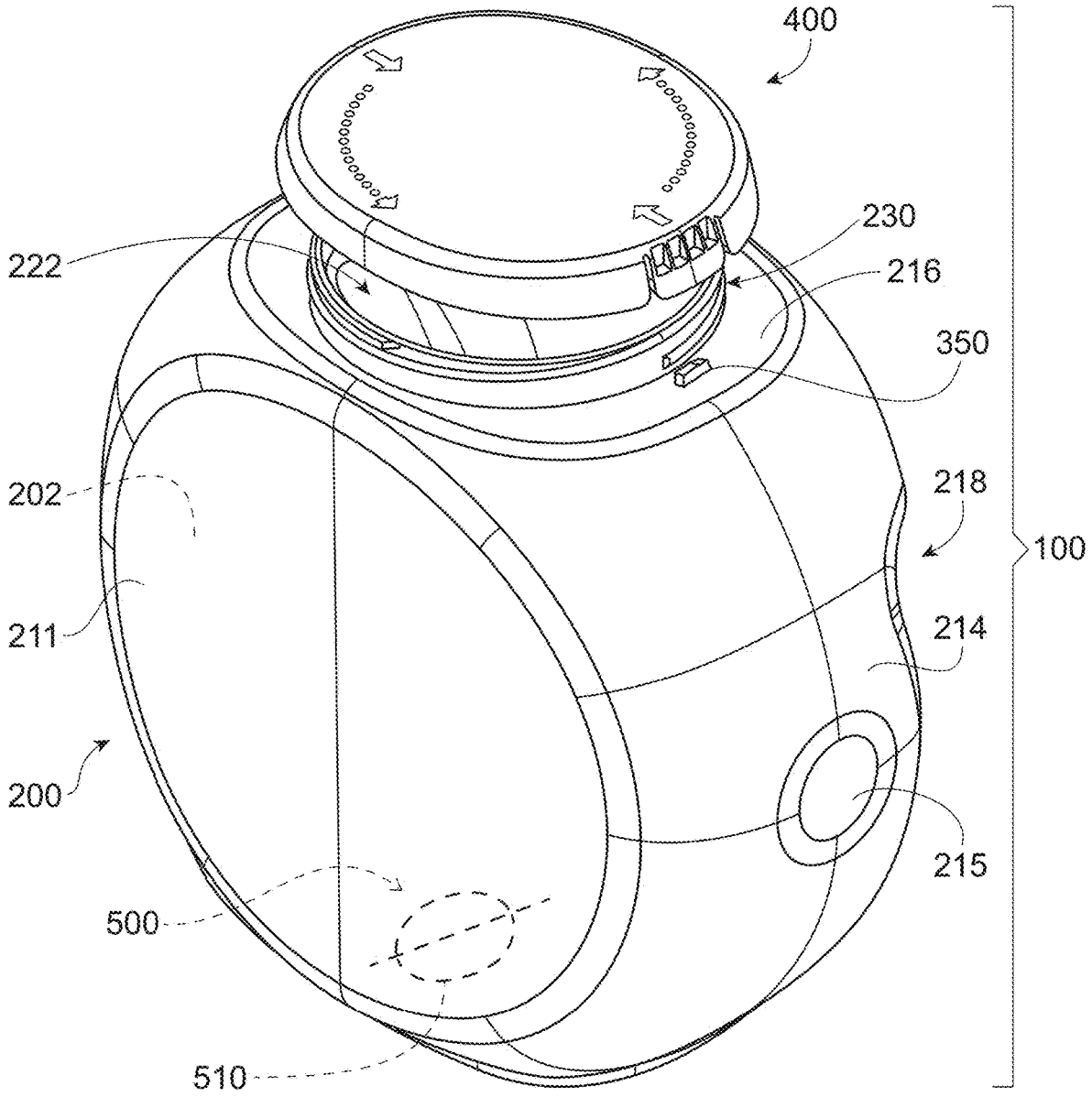
FIG. 2 shows a container system according to the present disclosure.

The container systems 100 of the present disclosure also address this problem by providing a two-piece container system 100 that includes contents of a certain size. As seen in FIG. 2, the container system 100 may include a container body 200, a closure 400, and contents, such as soluble unit dose articles. The opening of the container body 200 may be sized to be capable of receiving an adult human hand.

In both cases, the closure 400 may be dimensioned to be easily operated by a user.

The present disclosure also relates to closure 400 systems that include a shroud 300 and a closure 400 as described herein, where the closure 400 system is adaptable to a variety of container bodies 200 having different sizes and/or shapes.

The present disclosure also relates to a container that comprises a container body 200 and a shroud 300, as each component is described herein.

It is further noted that squeeze-and-turn closures may be preferred over known hinged closures for a number of reasons. For example, squeeze-and-turn closures typically do not have hinges that flex 180° or more upon each opening; these hinges may wear out with repeated use. Furthermore, squeeze-and-turn closures, which require a plurality of motions to open, may be more secure against accidental opening; for example, if a container is dropped, a hinged lid may be more likely to pop open.

As used herein, the articles "a" and "an" when used in a claim, are understood to mean one or more of what is claimed or described. As used herein, the terms "include," "includes," and "including" are meant to be non-limiting. The systems, compositions, and methods of the present disclosure can comprise, consist essentially of, or consist of, the elements of the present disclosure.

The terms "substantially free of" or "substantially free from" may be used herein. This means that the indicated material is at the very minimum not deliberately added to the composition to form part of it, or, preferably, is not present at analytically detectable levels. It is meant to include compositions whereby the indicated material is present only as an impurity in one of the other materials deliberately included. The indicated material may be present, if at all, at a level of less than 1%, or less than 0.1%, or less than 0.01%, or even 0%, by weight of the composition.

As used herein, "connectably engageable" means one component can be connected or attached to another. As used herein, it may also mean that the components may be capable of being selectively disconnected, disengageable, unattached, or removed from each other. For example, the closures 400 described herein may be attachable to and detachable from the shroud 300.

Unless otherwise noted, all component or composition levels are in reference to the active portion of that component or composition, and are exclusive of impurities, for example, residual solvents or by-products, which may be present in commercially available sources of such components or compositions.

All temperatures herein are in degrees Celsius (° C.) unless otherwise indicated. Unless otherwise specified, all measurements herein are conducted at 20° C. and under the atmospheric pressure.

In all embodiments of the present disclosure, all percentages are by weight of the total composition, unless specifically stated otherwise. All ratios are weight ratios, unless specifically stated otherwise.

It should be understood that every maximum numerical limitation given throughout this specification includes every lower numerical limitation, as if such lower numerical limitations were expressly written herein. Every minimum numerical limitation given throughout this specification will include every higher numerical limitation, as if such higher numerical limitations were expressly written herein. Every numerical range given throughout this specification will include every narrower numerical range that falls within such broader numerical range, as if such narrower numerical ranges were all expressly written herein.

Container Systems

The present disclosure relates to container systems 100. As shown in FIG. 1, the container system 100 may comprise at least three parts, such as a closure 400, a shroud 300, and a container body 200. As shown in FIG. 2, the container system 100 may comprise two parts, such as a closure 400 and a container body 200. The container system 100 may be adapted for containing any suitable contents or compositions 500, described in more detail below.

The container system 100 or any part thereof, may be formed utilizing any suitable materials. The container body 200 may be molded from a suitable plastic material such as polyethylene terephthalate. Any suitable polyolefins and/or polyesters may be used. The closure 400 and/or the shroud 300 or portions thereof may be formed partially or wholly of a moldable thermoplastic material, such as polypropylene, polyethylene, polystyrene, acrylonitryl butadiene styrene (ABS), polyester, polyvinyl chloride, polycarbonate or elastomer, or a blend of these materials. The closure 400 and/or shroud 300 may comprise polypropylene.

The container body 200 may be formed of a clear, transparent, or semi-transparent material, while the closure 400 may be formed of a substantially opaque material. The closure 400 may be translucent. The entire container system 100 (i.e, closure 400, shroud 300 if present, and container body 200) may be formed of substantially opaque materials. The closure 400 when formed of a substantially opaque material, can mask some of the empty volume at the top of the container body 200 when the container body 200 is formed of a clear material.

The materials used to form the container system 100 may have one or more colors. The container body 200, the closure 400, and the shroud 300 (if present) may all of the same color (e.g., all orange or all green). The container body 200 may be a different color than the closure 400 and/or the shroud 300 (if present) (e.g., white container body 200 and blue closure/shroud; or orange tub and silver closure/shroud). The colors may be selected to communicate the origin of the product (e.g., colors associated with the brand or manufacturer), the variant of the product (e.g., floral colors signaling particular perfume scents, or colors associated with a particular benefit or aspect of the contents, such as being free of dyes), or other signals as desired (e.g., seasonal or holiday colors).

The container systems 100, parts thereof, and methods of using such container systems are described in more detail below.

Closure

The present disclosure relates to closures 400, typically squeeze-and-turn closures. The closure 400 is configured to be rotatable around a rotation axis RA. The closure 400 can be rotated in a closing direction to a closed position. The closure 400 can be rotated in an opening direction that is counter to the closing direction to an open position. The closure 400 may be configured to be rotatably connectably engageable with a shroud 300 according to the present disclosure, where the closure 400 closes or seals the shroud opening 340 when the closure 400 is engaged with the shroud 300 in a closed position. See FIG. 1. The closure 400 may be configured to be rotatably connectably engageable with a container body 200 according to the present disclosure, where the closure 400 closes or seals the container body 200 opening when the closure 400 is engaged with the container body 200 in a closed position. See FIG. 2.

As shown, for example, in FIGS. 3-7, the closure 400 includes a top wall 410. The top wall 410 may have an outer surface 411 and an inner surface 412. The outer surface 411 faces away from the shroud 300 and/or the container body 200 when the closure 400 is in a closed position. The inner surface 412 faces the shroud 300 and/or container body 200 when the closure 400 is in a closed position. The top wall 410 may comprise an outer edge 413, which may define an upper periphery 414 of the closure 400.

The closure 400 includes an outer skirt 420 depending downwardly from the top wall 410 in a direction that is toward the shroud 300 and/or container body 200 when the closure 400 is in a closed position. The outer skirt 420 may depend downwardly from the top wall 410 at an outer edge 413 of the top wall 410. The closure 400 may transition from the top wall 410 to the outer skirt 420 at a shoulder 419.

The outer skirt 420 may terminate at a lower edge 422 that is distal from the top wall 410. At least a portion of the outer skirt 420 is flexible to allow for the push pad(s) 430, 440 and locking tab(s) 480, 490 to be flexed as described herein.

The outer skirt 420 includes at least a first push pad 430. The push pad 430 is capable of being pressed radially inward, towards the rotation axis RA. The container system 100 is configured so that when the closure 400 is in a closed position, the closure 400 is prevented from being rotated in an opening direction until at least the first push pad 430 is pressed radially inward.

Figure 3:
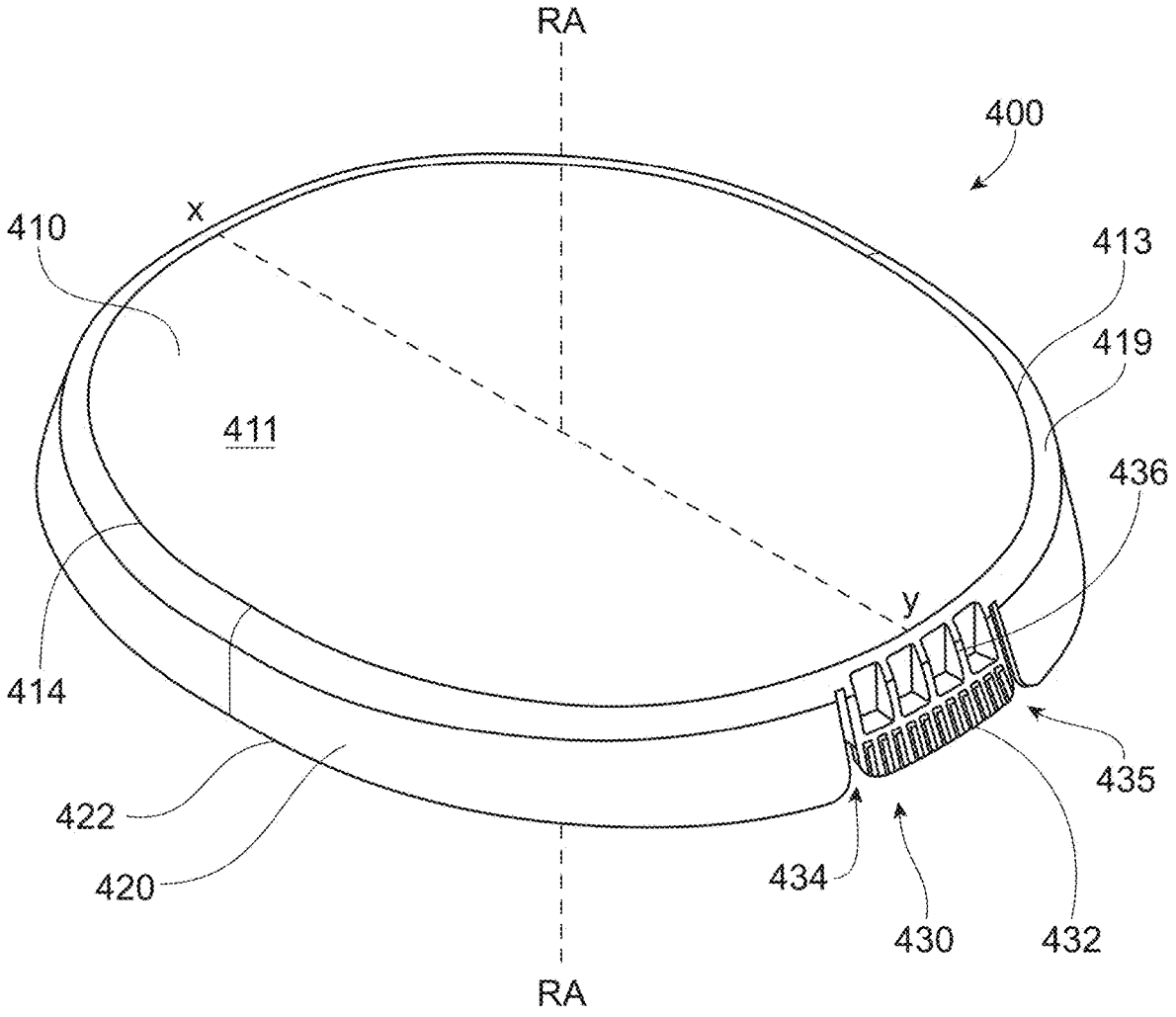
FIG. 3 shows a closure according to the present disclosure.
Figure 4:
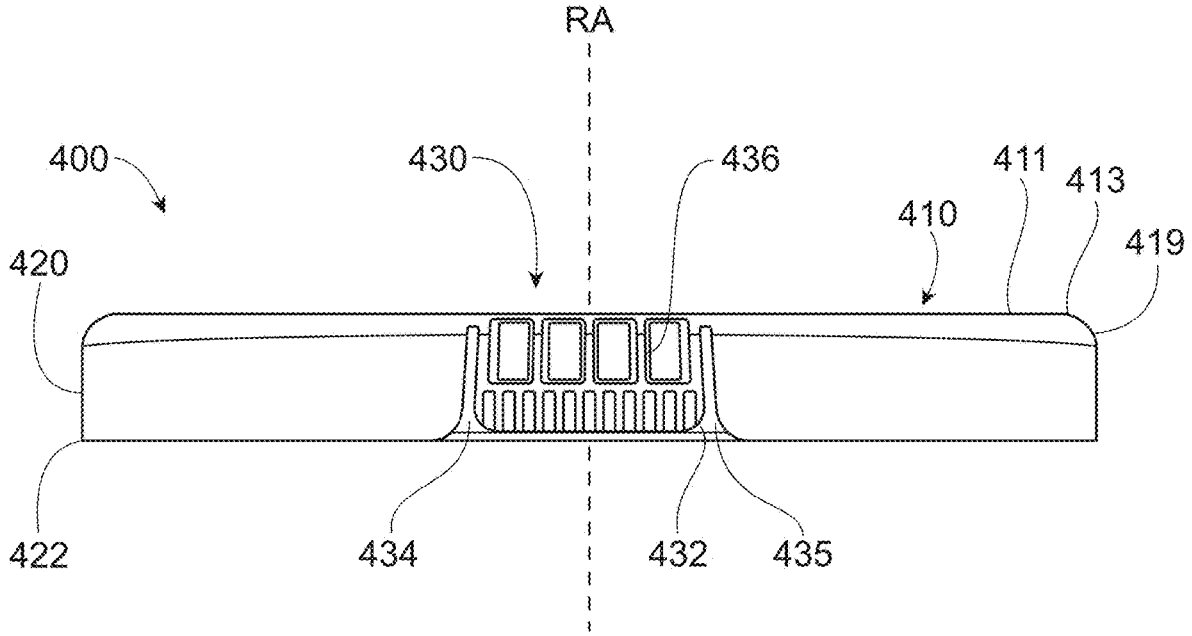
FIG. 4 shows a side view of a closure according to the present disclosure.

As can be seen in FIGS. 3-4, the push pad 430 may comprise a panel 432. The panel 432 may be formed by at least one slot 434 in the outer skirt 420, preferably two slots 434, 435. The slots 434, 435 may be a longitudinal slot extending from a lower edge 422 of the outer skirt 420 toward the top wall 410. The slots 434, 435 may extend a fraction of the outer skirt 420, or they may extend to or near to the outer edge 413 of the top wall 410. Slots 434, 435 may make the push pad 430, 440 easier to depress, as only a portion of the outer skirt 420 needs to be deformed in order to open the closure 400. Such a configuration may be particularly suitable for those with weak grip strength, such as the elderly.

The force required to flex the push pad 430, 440 may be adjusted by selecting panel and/or slot length, hinge placement, stiffening ribs, materials used, intentional areas of weakness (e.g., due to thinned areas, scoring, apertures, etc.), or other variables evident to one of ordinary skill. The pressing force required to disengage the locking tabs 480, 490 from the locking lugs 350, 360 is typically from about 1 pound to about 5 pounds, or from about 1.5 pounds to about 3 pounds.

The push pad 430, 440 may include irregularities 436, such as ribs, bumps, and/or dimples. Such irregularities 436 may provide friction and make the pad 430, 440 easier to grip when pressing the push pads 430, 440 and/or turning the closure 400.

Figure 5:
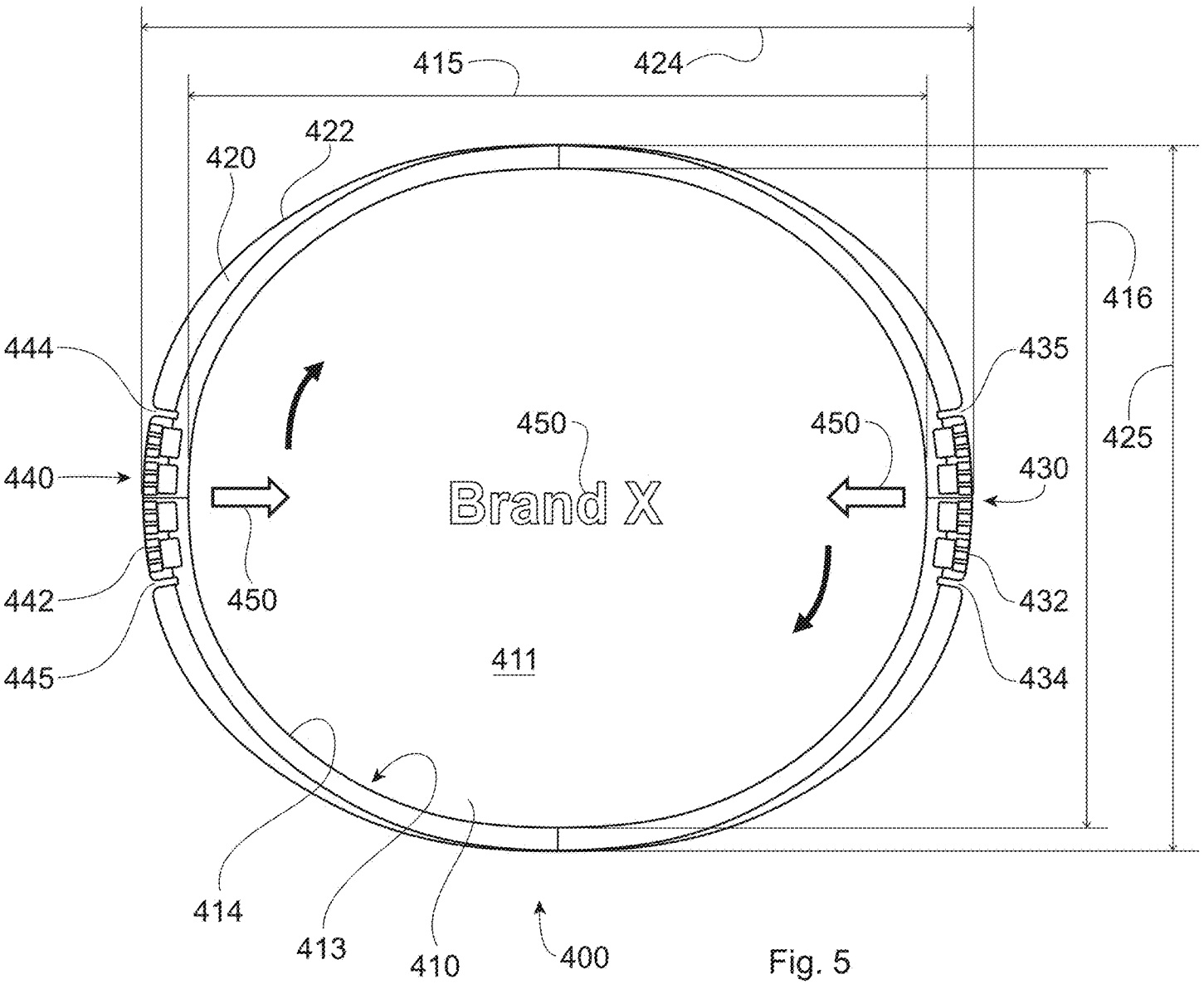
FIG. 5 shows a top view of a closure according to the present disclosure.

As shown in FIG. 5, the closure 400 may include a first push pad 430 and a second push pad 440. Each push pad 430, 440 may comprise a panel 432, 442 formed from slots 434, 435, 444, 445. The container system 100 may be configured so that the closure 400 is prevented from being rotated in an opening direction until the second push pad 440 is pressed radially inward, preferably at the same time as when the first push pad 430 is pressed radially inward. Two or more push pads 430, 440 may be preferred to increase the security of the container system 100, as a more complex action is required to open the closure 400.

The first and second push pads 430, 440 may be circumferentially spaced apart by from about 45° to about 180°, preferably from about 90° to about 180°, more preferably about 180°. The first and second push pads 430, 440 may be diametrically opposed.

When viewed from the top and/or bottom, the closure 400 may be asymmetrical. Having an asymmetrical closure (i.e., where one axis is greater than another) may be useful for a number of reasons. For example, when the closure 400 is not in a properly closed position, the misalignment of an asymmetric closure 400 with the shroud 300 and/or container body 200 can provide a visual signal to alert the user or manufacturer. Additionally, an asymmetric closure 400 may conform better to an asymmetric container body 200, for example one that is wider than it is deep, which may provide maximum shelf impression.

As shown in FIG. 5, when viewed from the top, the top wall 410 of the closure 400 may include a major axis 415, measured from one side of the outer edge 413 of the top wall 410 to the opposite side along a major dimension. See also line X-Y of FIG. 3. The top wall 410 of the closure 400 may include a minor axis 416, measured from one side of the outer edge 413 to an opposite side. At least one or both of the axes 415, 416 may be selected and configured to be smaller than the maximum functional hand span of the average adult human hand, so that the closure 400 can be operated with one hand. The length of the major axis 415 may be greater than the length of the minor axis 416. The major axis 415 may have a length of from about 70 mm to 130 mm, or from about 80 mm to about 120 mm, or from about 90 mm to about 110 mm, or from about 95 mm to about 105 mm, or about 100 mm. The minor axis 416 may have a length of from about 50 mm to about 120 mm, or from about 70 mm to about 110 mm, or from about 80 mm to about 100 mm, or about 90 mm. The ratio of the major axis 415 to the minor axis 416 may be from about 2:1, or from about 1.5:1, or from about 1.3:1, or from about 1.2:1, or from about 1.15:1, to about 1:1.

The closure 400 may have an upper periphery 414 about the outer edge 413 of the top wall 410. The closure 400 may have a lower periphery 423 about the lower edge 422 of the outer skirt 420, ignoring any gaps or slots in the lower edge 422. The lower periphery may have a major axis 424 and a minor axis 425. The lower periphery 423 may be larger than the upper periphery 414, such as when the outer skirt 420 extends downwardly from the top wall 410 and radially outward. This configuration may be preferred to provide a more unitary look to the container system 100; for example, the slope of the outer skirt 420 could substantially match the slope on a part of the shroud 300 and/or container body 200. The outer skirt 420 may extend axially downwardly and not radially outward (i.e., substantially straight downwardly), so that the lower periphery 423 may be approximately the same size as the upper periphery 414. The outer skirt 420 may even extend downwardly and radially inward, so that the lower periphery 423 may be smaller than the upper periphery 414. This configuration may be preferred to increase the security of the closure 400, as the pressing pads 430, 440 may be more challenging to depress, or to increase the grippability of the closure 400, as the top wall 410 may fit more securely in the palm of the user's hand as the user's fingers curl down the side.

The closure 400 may include indicia 450. The indicia 450 may be located on the top wall 410, including the outer surface of the top wall 410. The indicia 450 may be molded integrally with, printed on, and/or affixed (such as by label or sticker) to the closure 400. The indicia 450 may comprise text, a graphic, or a combination thereof. The indicia 450 may indicate: the origin of the container system 100 or closure system 150; the manufacturer of the container system 100 or closure system 150; an advertising, sponsorship, or affiliation image; a trademark or brand name; a safety indication; an instructional indication; a product use or function indication; a sporting image; a geographical indication; an industry standard; preferred orientation indication; an image linked to a perfume or fragrance; a charity or charitable indication; an indication of seasonal, national, regional or religious celebration, in particular spring, summer, autumn, winter, Christmas, New Years; or any combination thereof. Further examples include random patterns of any type including lines, circles, squares, stars, moons, yin yang symbols, flowers, animals, snowflakes, leaves, feathers, sea shells, and Easter eggs, among other possible designs. The indicia 450 may indicate a safety indication, an instructional indication, a trademark or brand name, or combinations thereof. The instructional indication may indicate how to open the container system 100, for example with arrows indicating the direction to depress the moveable panels and/or arrows showing the direction of rotation required to open the container system 100. The shroud 300 and/or container body 200 may comprise, for example on the shoulder 320, any of the indicia 450 described above.

Because the closures 400 of the present disclosure may be used for container systems 100 that require openings large enough to fit a human hand, the closures 400 may be wider than they are tall. This configuration can allow a user's fingers to span across the relatively wide opening while still being able to reach and operate the push pads 430, 440 of the outer skirt 420.

Figure 6:
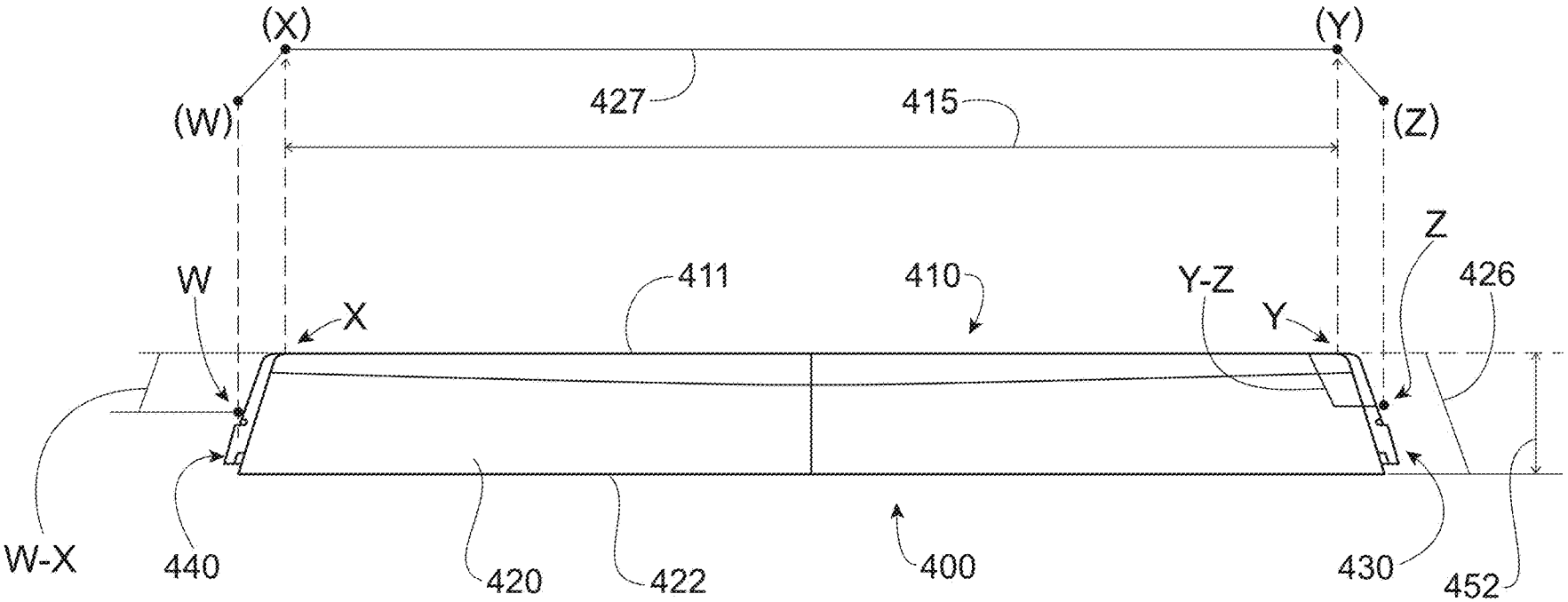
FIG. 6 shows front view of a closure according to the present disclosure.

As seen in FIG. 6, the closure 400 may have a height 452, measured from a horizontal plane extending from the lower edge 422 of the outer skirt 420 to a parallel horizontal plane extending from the top wall's outer surface 411. The closure height 452 may be from about 5 mm to about 50 mm, or from 7 mm to about 30 mm, or from about 8 mm to about 25 mm, or from about 10 mm to about 20 mm. The ratio of closure height 452 to the major axis 415 of the closure's top wall 410 may be from about 10:1 to about 1:15, or from about 5:1 to about 1:12, or from about 1:1 to about 1:10, or from about 1:5 to about 1:10, or from about 1:8 to about 1:10. The height 452 of the closure 400 may be at least 50% less, preferably at least 75% less, than the length of the major axis of the closure's top wall 410. The ratio of closure height 452 to the major axis 415 of the closure's top wall 410 may be selected to fit the maximum functional hand span of an adult hand while still allowing fingers to depress the panels 432, 442.

As shown in FIG. 6, the outer skirt 420 may have an outer skirt length 426, measured as the distance from the lower edge of the skirt 422 to the outer edge 413 of the top wall 410. The skirt length 426 may be at least 50% less, preferably at least 75% less, than the length of the major axis 415 of the closure's top wall 410. If the outer skirt 420 is not substantially orthogonal to the top wall 410, the skirt length may be greater than the height of the closure 400.

The closure 400 may have a span length 427. As used herein, "span length" 427 of the closure 400 is measured from the middle of one push pad (W), to the outer edge of the top wall (X), across the top wall to the opposite outer edge (Y), to the middle of the opposite push pad (Z). In FIG. 6, the span length 427 is equivalent to total length of the line that is drawn from point W to point X to point Y to point Z (or "line W-X-Y-Z"). The span length 427 may be selected to fit the maximum functional hand span of an average adult human hand. The span length 427 may be adjusted depending on the target population of container system users; for example, females tend to have shorter hand spans than males. The span length 427 may be from about 50 mm, or from about 70 mm, or from about 90 mm, or from about 105 mm, to about 150 mm, or to about 130 mm, or to about 120 mm, or to about 115 mm or to about 110 mm.

Figure 7:
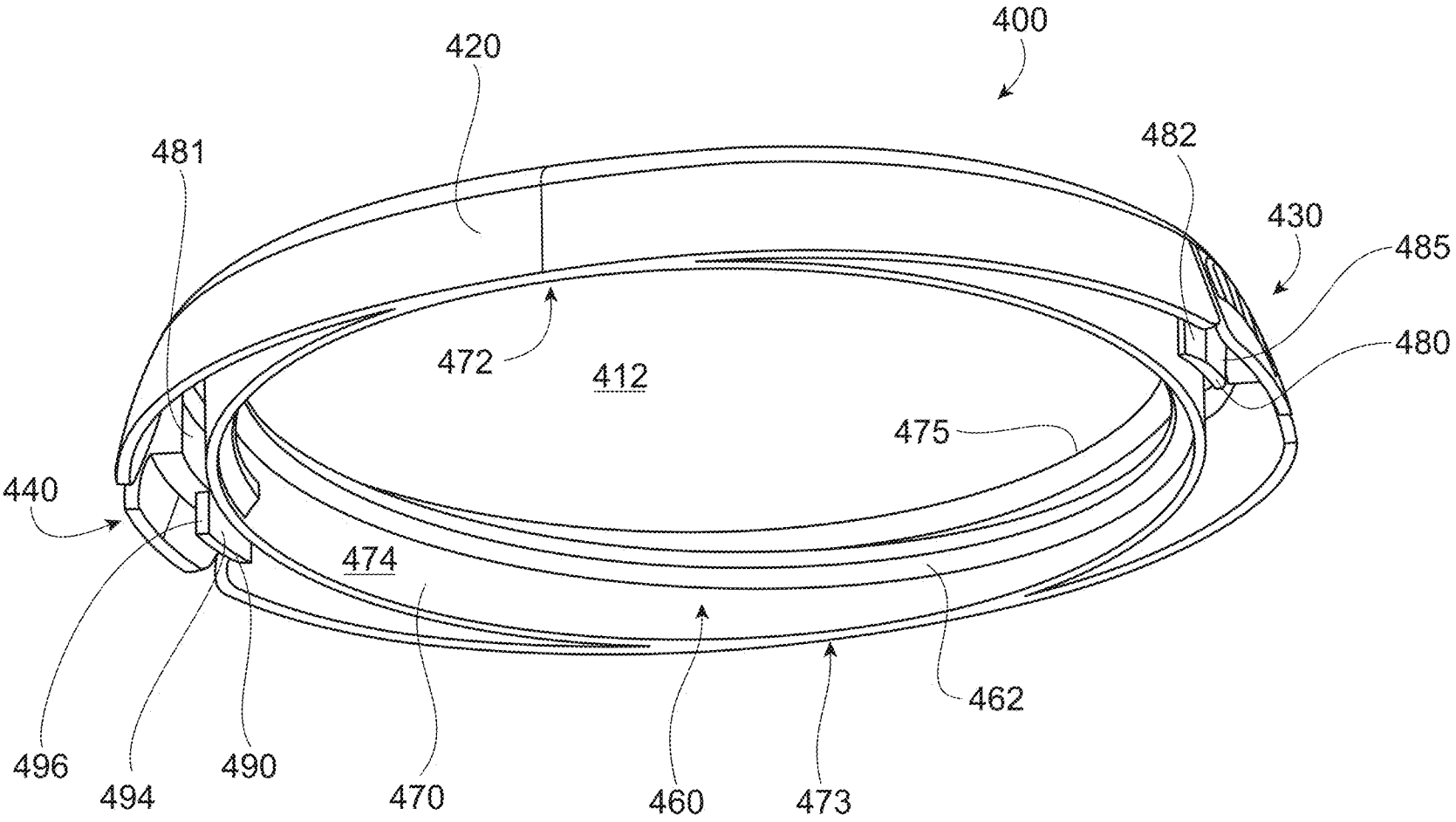
FIG. 7 shows a bottom perspective view of a closure according to the present disclosure.

As shown in FIG. 7, the closure 400 includes a connecting feature 460 capable of engaging with a complimentary connecting feature 330 on the shroud 300 and/or container body 200. The connecting feature 460 may include at least one thread 462, or at least two threads. The connecting feature 460 may include lugs that are received by receiving notches when the closure 400 is rotated in a closing direction.

The closure 400 may include an inner skirt 470 that depends downwardly from the inner surface 412 of the top wall 410. The inner skirt 470 may be positioned radially inward to the outer skirt 420. The inner skirt 470 may intersect with the outer skirt 420 at one or more intersection points 472, 473. The inner skirt 470 may comprise the connecting feature 460, such as one or more threads 462, typically on an inner surface 474 of the inner skirt. The inner surface 474 may be continuous, as shown in FIG. 7, or it may be discontinuous, for example when the inner skirt 470 comprises a plurality of spaced portions.

The connecting feature 460 of the closure 400 (e.g., threads) and the complimentary connecting feature 330 on the shroud 300 and/or container body 200 may be configured to allow the closure 400 to be removable from the shroud 300 and/or container body 200 upon relatively rotating the closure 400 from the closed position in an opening direction by not more than about 180°, preferably by not more than about 135°, more preferably by not more than about 90°. This provides the effect of the closure 400 being removeable after a half-turn, or even a quarter-turn, in the opening direction. Such a configuration can allow a user to open the container system 100 with one hand without having to release the closure 400 and reset the hand position for a second turn, allowing for quick and convenient access.

Figure 8:
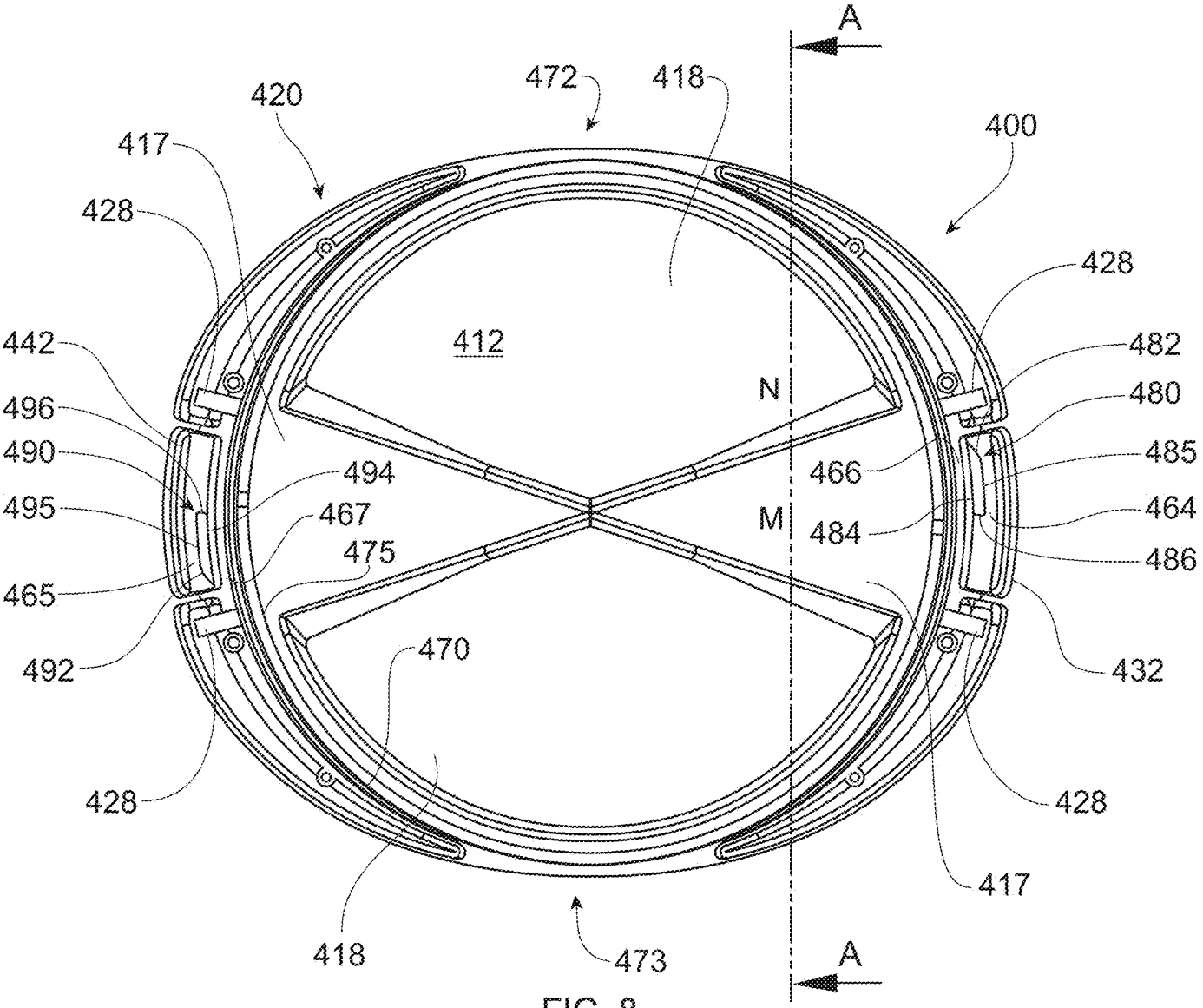
FIG. 8 shows a bottom view of a closure according to the present disclosure.

As seen in FIGS. 7 and 8, the closure 400 comprises at least a first locking tab 480. The outer skirt 420 may comprise the first locking tab 480. The first locking tab 480 is configured to engage a first locking lug 350 located on the shroud 300 or container body 200 when the closure 400 is in the closed position to prevent rotation of the closure 400 in the opening direction. Pushing the first push pad 430 radially inward causes the first locking tab 480 to disengage with the first locking lug 350, and the closure 400 may then be able to be rotated in an opening direction while the first push pad 430 is being pressed.

The closure 400 may comprise more than one locking tab 480, 490. The number of locking tabs 480, 490 may be equal to the number of push pads 430, 440.

The closure 400 may comprise a second locking tab 490. The outer skirt 420 may comprise the second locking tab 490. The second locking tab 490 may be configured to engage a second locking lug 360 on the shroud 300 or container body 200 when the closure is in the closed position to prevent rotation of the closure 400 in the opening direction. Pushing the second push pad 440 radially inward may cause the second locking tab 490 to disengage with the second locking lug 360, and the closure 400 may then be able to be rotated in an opening direction while the second push pad 440 is being pressed, typically simultaneously as when the first push pad 430 is being pressed.

As shown in the closures 400 of FIGS. 7 and 8, the locking tabs 480, 490 may be in substantially radial alignment with the push pads 430, 440. The locking tabs 480, 490 may be located radially inward from the push pads 430, 440. When the push pad 430, 440 is pressed radially inward, the locking tabs 480, 490 may flex radially inward. The locking tabs 480, 490 may extend axially downwardly, away from the top wall 410. The locking tabs 480, 490 may be molded integrally with the push pads 430, 440 and/or panels 432, 442, and/or may be joined to the pad or panel by a web of material 481. The locking tab 480, 490 may be substantially parallel to the push pad 430, 440 or panel 432, 442. The locking tab 480, 490 may be approximately equal in width to the entire width of the panel 432, 442, for example as measured between the slots 434, 435, 444, 445. The width of the locking tab 480, 490 may be less than the width of the panel 432, 442, for example approximately three-quarters or less, or approximately half or less, or approximately half.

The locking tab 432, 442 may have a tab leading face 482, 492 that leads when the closure 400 is rotated in a closing direction. The tab leading face 482, 492 may be rounded or angled, which can help to facilitate the deflection of the locking tab 480, 490 upon rotation in a closing direction as it encounters the locking lug 350, 360. The tab leading face 482, 492 may be the narrowest part of the locking tab 480, 490, which can also help to facilitate the deflection of the locking tab 480, 490 upon rotation in a closing direction as it encounters the locking lug 350, 360. The tab leading face 482, 492 may be configured to deflect the locking tab 480, 490 radially outward or radially inward when the locking tab 480, 490 encounters the locking lug 350, 360, which is typically stationary, upon closing.

The locking tab 480, 490 may have an inner surface 484, 494 that faces radially inward. The locking tab 480 490 may have an outer surface 485, 495 that faces radially outward. The inner and/or outer surfaces may be flat, or one or both surfaces may have a slight curve, for example, to match the arc of a circumference of a circle at the particular radius at which the surface can be found.

The locking tab 480, 490 may have a tab locking face 486, 496 opposite the tab leading face 482, 492. The tab locking face 486, 496 may engage the locking lug 350, 360 when the closure 400 is in a closed position to prevent rotation in the opening direction. The tab locking face 486, 496 may be relatively flat to maximize contact with the locking lug 350, 360. In the radial direction, the tab locking face 486, 496 may be the widest part of the locking tab 480, 490.

As shown in FIGS. 7 and 8, the closure 400 may have an outer gap 464, 465 between the outer surface 485, 495 of the locking tab 480, 490 and the outer skirt 420. The closure 400 may have an inner gap 466, 467 between the inner surface 484, 494 of the locking tab 480, 490 and the inner skirt 470. One or more gaps 464, 465, 466, 467 may be sized to allow passage of the locking lugs 350, 360 when the closure 400 is rotated in an opening and/or closing direction. The closure 400 may be configured so that the locking lugs 350, 360 pass through one of the gaps (e.g., the inner gap 466, 467) when the closure 400 is rotated in the closing direction, and through the other gap (e.g., the outer gap 464, 465) when the closure 400 is rotated in the opening direction. This configuration can provide the advantage of balancing outward deflection of the panels 432, 442 upon closing with inward deflection of the panels 432, 442 upon opening, thereby reducing deformation or loss of plasticity of the pressing pads 430, 440 that may result from a single direction of flexion.

While it may be desirable for at least the push pads 430, 440 to be depressible, such flexibility may not be desired at other points of the closure 400, or even at other points of the outer skirt 420. Thus, the closure 400 may include support walls 428, which may help to increase rigidity at least at certain points of the closure 400. For example, the support walls 428 may extend between the outer skirt 420 and the inner skirt. The support walls 428 may extend in a substantially radial direction. The support walls 428 may be spaced apart from the pressing pads 430, 440.

As seen in FIG. 8, the top wall 410 may have areas of differing thicknesses, including an area of increased thickness 417 and an area of decreased thickness 418. Relatively thicker portions 417 may provide increased structural support for the closure 400, particularly in areas of stress, such as along an axis between the push pads. Relatively thinner portions 418 may provide greater flexibility where flexing is desirable or even cost savings, as less material is required. The thicker portions 417 may be located along the major axis 415 of the top wall 410, along an axis connecting the press pads 430, 440, adjacent a perimeter 475 of the inner skirt 470, or a combination thereof.

Figure 9:
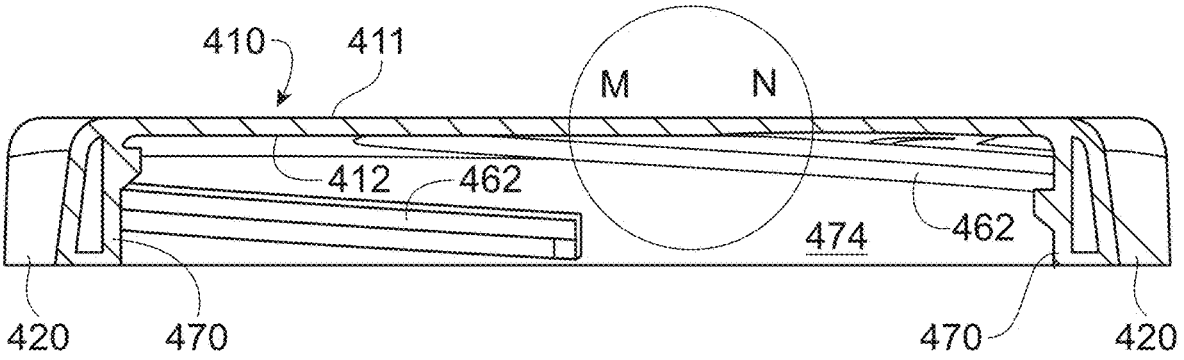
FIG. 9 shows a cross-section view along the line A-A in FIG. 8.
Figure 10:
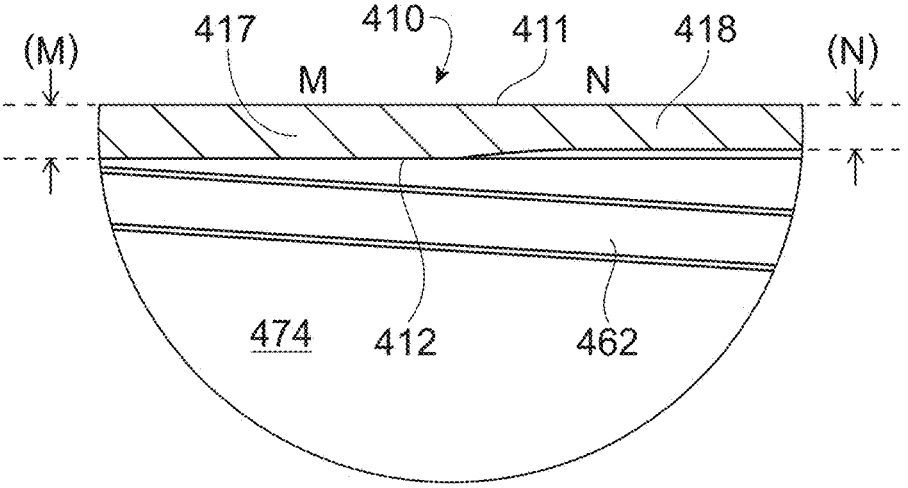
FIG. 10 shows a detail of FIG. 9.

FIG. 9 shows a cross-section of the closure 400 of FIG. 8, viewed along line A-A. The closure 400 includes thick portions 417 and thin portions 418. FIG. 10 shows a detail of FIG. 9. The thickness of the thick portion 417 is represented by M. M may be from about 0.5 mm, or from about 0.75 mm, or from about 1.0 mm, or from about 1.25 mm, or from about 1.45 mm, and to about 5 mm, or to about 4 mm, or to about 3 mm, or to about 2 mm, or to about 1.75 mm, or to about 1.55 mm; M may be about 1.5 mm. The thickness of the thin portion 418 is represented by N. N may be from about 0.5 mm, or from about 0.75 mm, or from about 1.0 mm, or from about 1.1 mm, or from about 1.2 mm, and to about 4 mm, or to about 3 mm, or to about 2 mm, or to about 1.75 mm, or to about 1.5 mm, or to about 1.3 mm. N may be about 1.25 mm. M is typically greater than N. The thickness of the thick portion 417 of the top wall (M) may be at least about 105%, or at least about 110%, or at least about 120%, or at least about 125% greater than the thickness of the thin portion 418 of the top wall (N). The thickness of the top wall 410 at various points can be determined with calipers of suitable precision.

Figure 11:
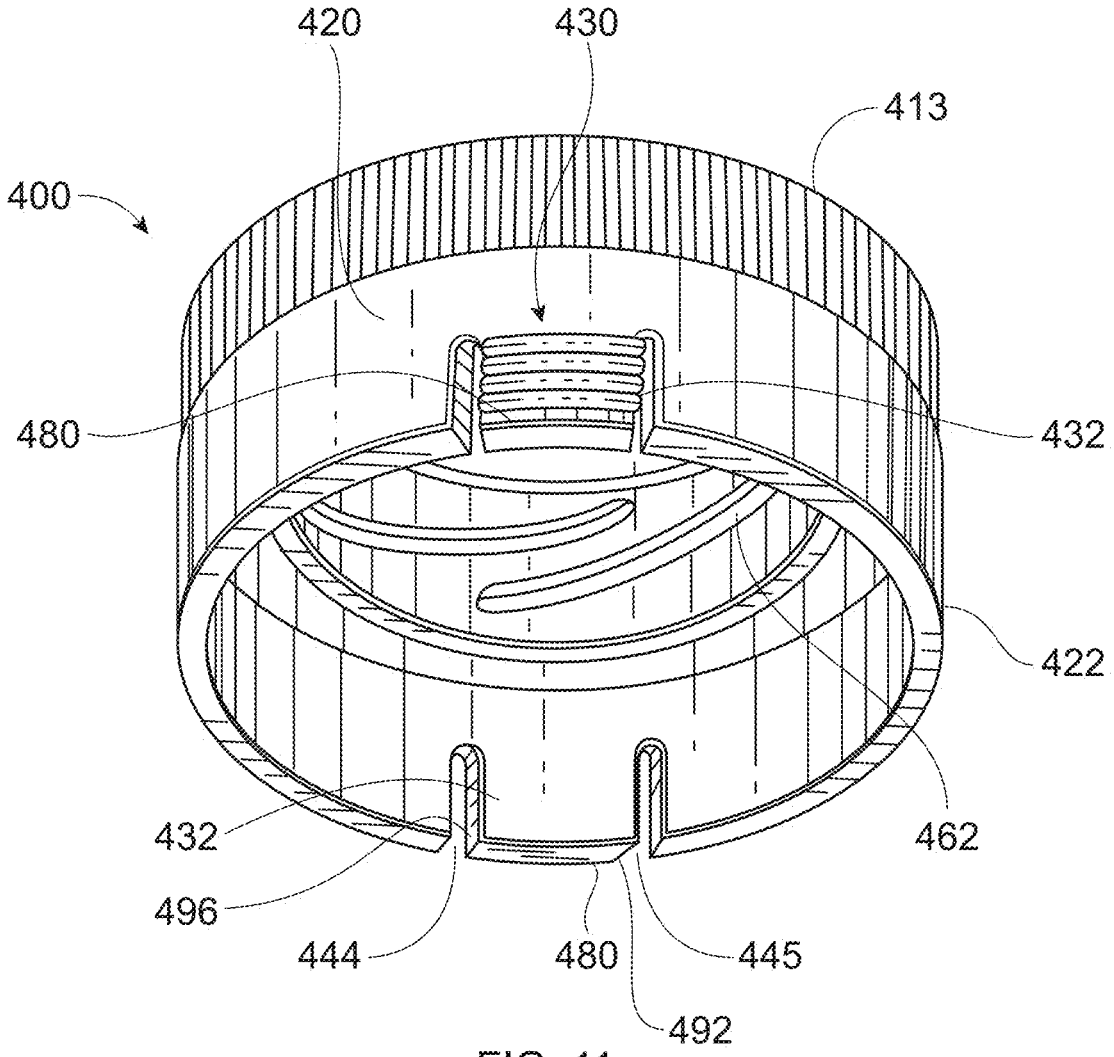
FIG. 11 shows a closure according to the present disclosure.

In the closure 400 of FIG. 11, the locking tab 480, 490 is part of the panel 432, 434 and is located at the lower edge 422 of the skirt. The locking tab 480, 490 is in substantially radial alignment with the push pad 430, 440, but it is not located radially inward from the push pad 430, 440. Rather, it is coextensive with and/or axially below the push pad 430, 440. A portion of the locking tab 480, 490 (e.g., a tab locking face 486, 496) may extend radially outward from an adjacent portion of the outer skirt 420, so that the locking tab 480, 490 can engage with the locking lug 450, 460. When the push pad 430, 440 is pressed radially inward, the locking tab 480, 490 also flexes radially inward.

The closure 400 of FIG. 11 also shows that the closure 400, in some cases, may not have an inner skirt 470. The connecting features 460 (e.g., threads 462) of the closure 400 may be located on an inner surface of the outer skirt 420. In such cases, the closure 400 should be configured so that the push pads 430, 440 of the outer skirt 420 may still be pressed inward.

Figure 12:
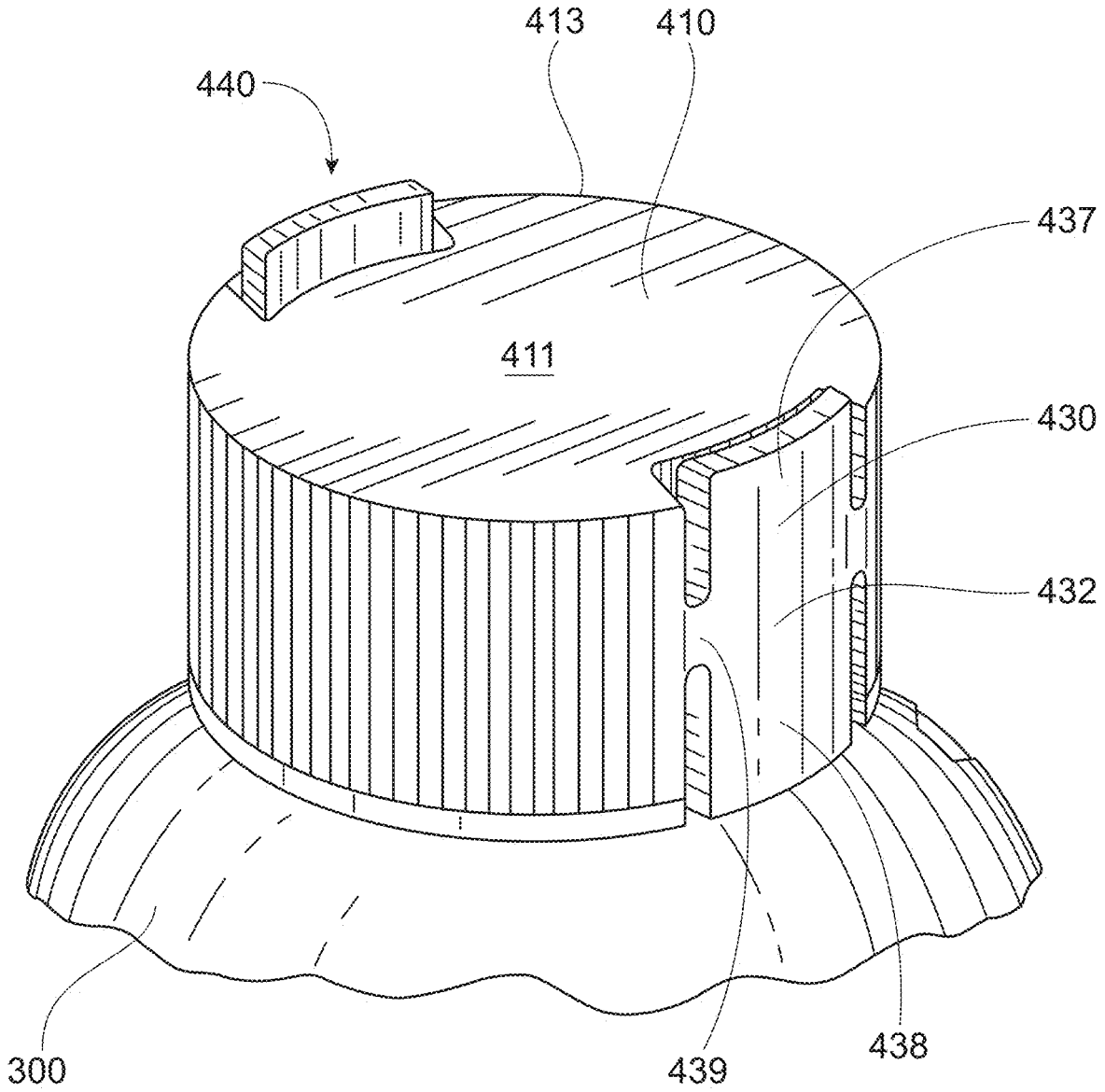
FIG. 12 shows a closure according to the present disclosure.

The closure 400 may be configured so that when the push pad 430, 440 is pressed radially inward, the locking tab 480, 490 flexes radially outward. For example, the closure 400 of FIG. 12 includes a panel 432 having the push pad 430 at a first end 437 of the panel 432, the locking tab (not shown) at a second end 438 of the panel 432 opposite the first end 437, and a fulcrum 439 located therebetween and attached to an adjacent portion of the outer skirt 420. The locking tab 480 is in substantially radial alignment with the push pad 430, but is axially below the push pad 430. A portion of the locking tab 480 may extend radially outward from an adjacent portion of the outer skirt 420 (e.g., a locking face), so that the locking tab 480 can engage with the locking lug 450. When the push pad 430 is pressed radially inward, the locking tab 480 flexes radially outward.

Figure 13:
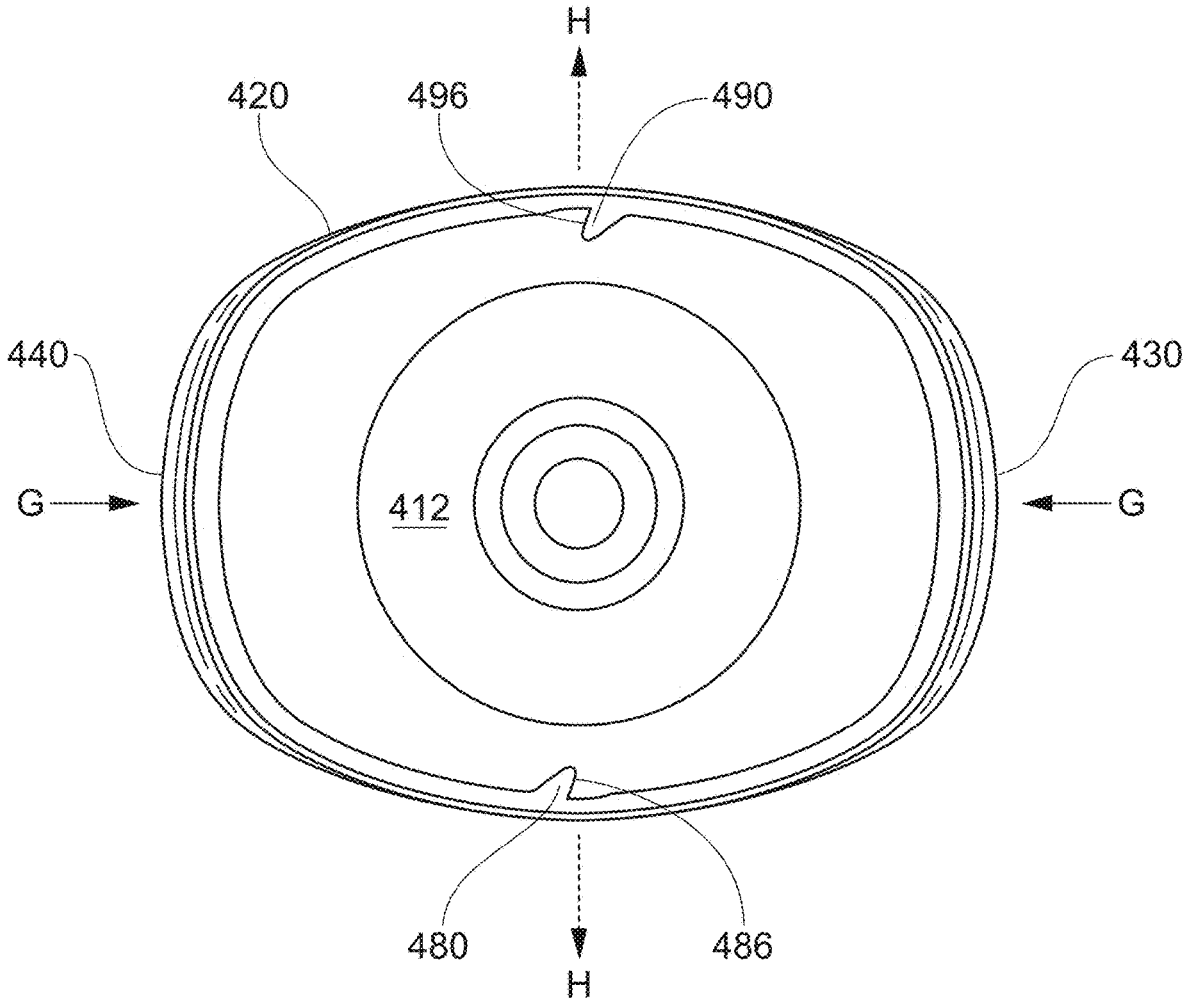
FIG. 13 shows a closure according to the present disclosure.

The locking tabs 480, 490 may be circumferentially spaced away from the push pads 430, 440. For example, the closure 400 of FIG. 13 (shown as a bottom plan view) includes locking tabs 480, 490 that are circumferentially spaced by about 90° from the push pads 430, 440. When the push pads 430, 440 are pressed inward (signified by arrows marked G), the locking tabs 480, 490 flex outward (signified by arrows marked H) due to the flexible material of the outer skirt 420. In such configurations, it may be desirable for the outer skirt 420 to be continuous and not interrupted by slots and/or discrete panels, so that the pressing force can be easily transferred to the areas of the skirt 420 near the locking tabs 480, 490.

The closure 400 may comprise a water-sealing structure. This is particularly preferred when it is anticipated that the contents of the container system 100 are water-sensitive, e.g., articles that degrade or dissolve in the presence of water in liquid and/or vapor form. The water-sealing structure may be a plug seal, a gasket seal, or a combination thereof. The container system 100 may comprise a hygroscopic material, e.g., a desiccant.

When the closure 400 is in the closed position, the container system 100 may have a MVTR measurement of less than about 2.0 grams per day per square meter of package surface (g/day/m^2), or less than about 1.0 g/day/m^2, or less than about 0.75 g/day/m^2, or less than about 0.50 g/day/m^2, or less than about 0.25 g/day/m^2, at 35° C. and 65% relative humidity. MVTR is determined according to ASTM D7709.

The closure 400 may comprise one or more stacking features to facilitate the stacking of closure systems 150, or container systems 100 on top of one another. The stacking feature may be configured to be received by the closure 400, the closure systems 150, or the container systems 100 that are stacked on top of it. For example, the stacking feature may be configured to extend into the opening 340 of the shroud 300, to nest inside the inner skirt 470 of the closure 400, and/or to engage with the bottom wall 210 of the container body 200, e.g., by encircling or nesting within the bottom wall 210 when container body 200 is stacked on top of the closure 400. The one or more stacking features may be one or more ridges that project axially away from the outer surface of the top wall 410. The stacking features may be continuous or intermittent. The stacking features may be located at or near the outer edge of the top wall 410. The stacking features may have a shape that is complimentary to the shape defined by the top wall outer edge 413, or the stacking structures may have a different shape.

Even when the closure 400 is disengaged or detached from opening of the shroud 300 or container body 200 so that the container system 100 is in an open position, the closure 400 may still be attached to the shroud 300 or container body 200. For example, the closure 400 may be attached to the shroud 300 or container body 200 by a hinge, or by a hinged piece that allows rotation of the closure 400. The closure 400 may be attached to the shroud 300 or container body 200 by a retaining structure, such as a strap, having a first end attached to the shroud 300 or container and a second end attached to the closure 400. Such features may be useful to prevent closure 400 becoming separated or lost from the rest of the container system 100.

Shroud

The container systems 100 of the present disclosure may include a shroud 300. The shroud 300 may be configured to be an intermediate or transition piece between the closure 400 and the container body 200. As described above, an advantage of a shroud 300 in the present container systems 100 is that the opening to the container body 200 can be large to facilitate filling, while the opening onto which the closure 400 connects can be relatively smaller, so that the closure 400 can conveniently be operated with one hand. Other advantages include the flexibility to use the same closure 400 and shroud 300 with container bodies of different sizes and/or shapes. Use of a shroud 300 or a plurality thereof also allows the same closure 400 to be used with shrouds 300, 301 of different sizes and/or shapes, providing the manufacturer with a greater degree of flexibility and cost-savings. Compare, for example, FIG. 1 and FIG. 20.

Figure 14:
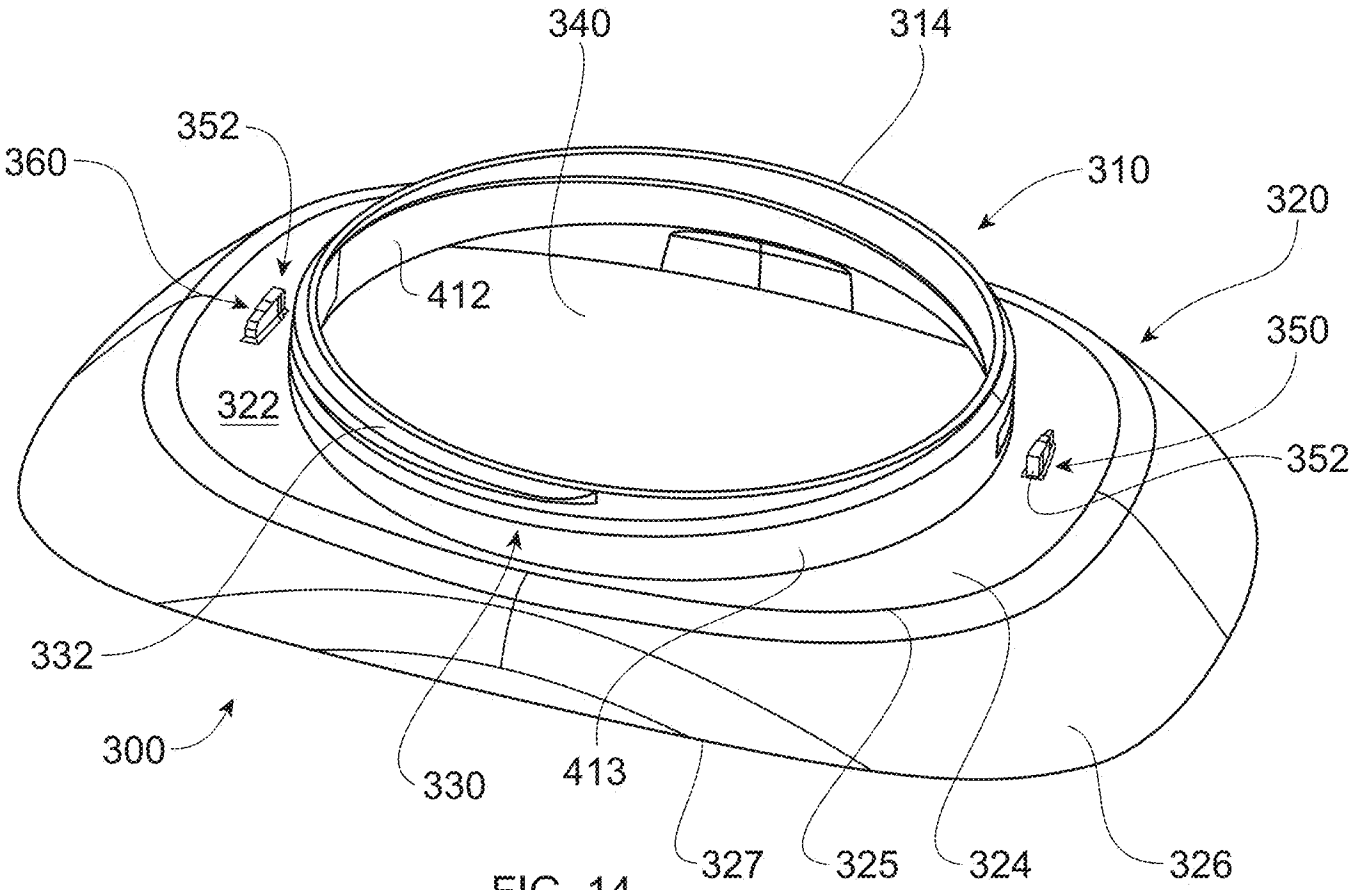
FIG. 14 shows a shroud according to the present disclosure.
Figure 15:
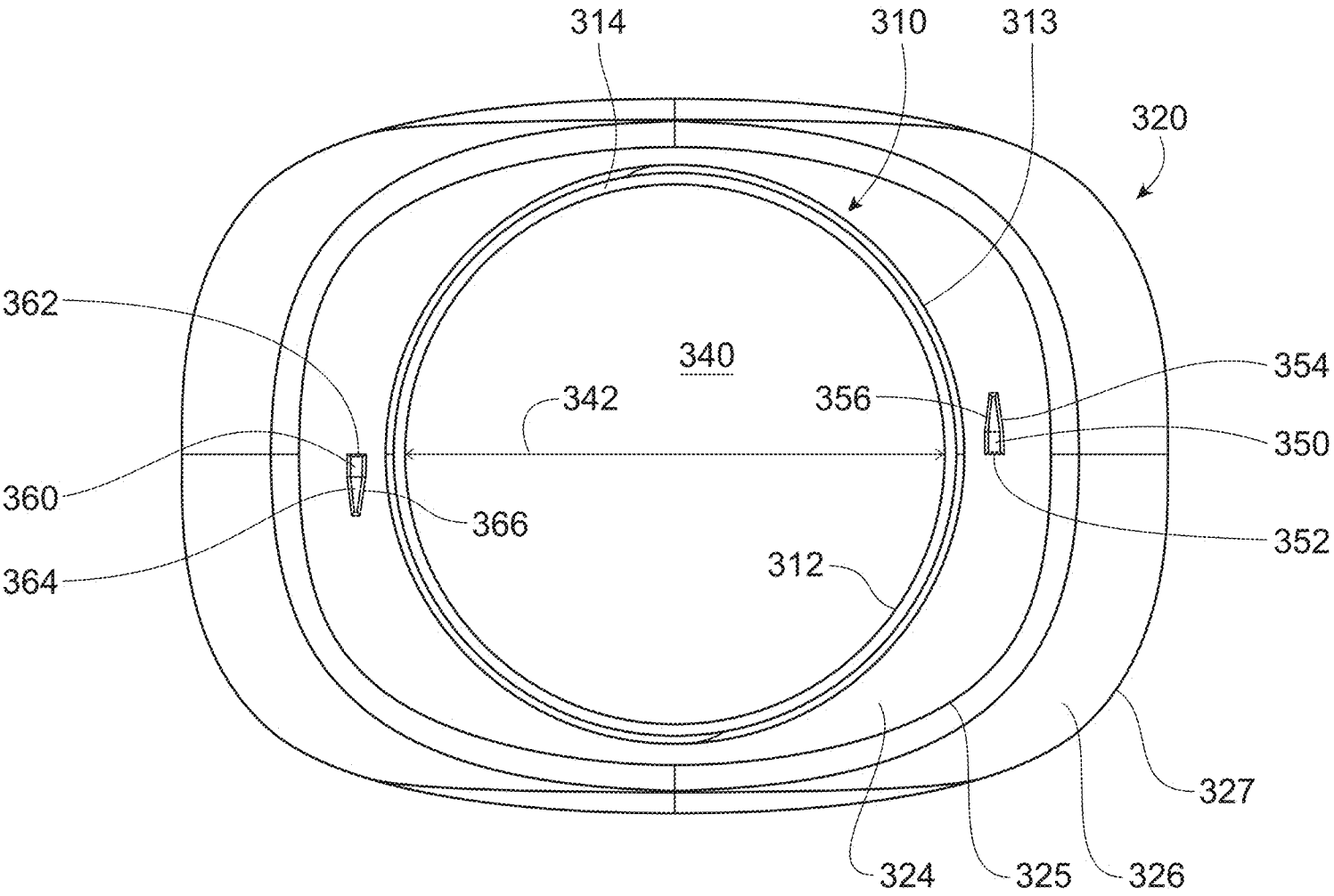
FIG. 15 shows a top view of a shroud according to the present disclosure.
Figure 16:
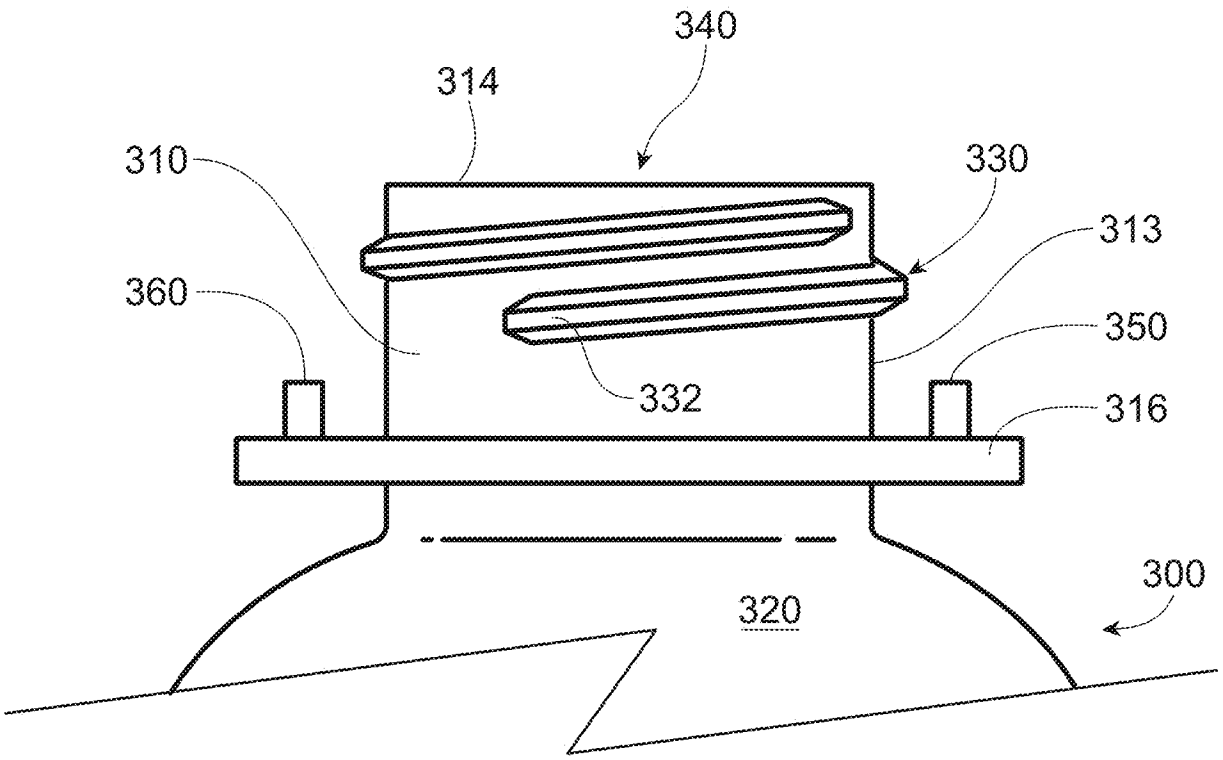
FIG. 16 shows a shroud according to the present disclosure, where the shroud includes a flange.

The shroud 300 may be configured to be connectably engageable with the container body 200 and, separately, to the closure 400. FIGS. 14-16 show exemplary shrouds 300 according to the present disclosure.

As shown in FIGS. 14 and 15, the shroud 300 may include a neck 310. The neck 310 may project axially upwardly from a shoulder 320 of the shroud 300. The neck 310 may have an inner surface 312 facing radially inward and an outer surface 313 facing radially outward. The neck 310 may include a complimentary connecting feature 330 that is capable of engaging with the connecting features 460 on the closure 400 to securely close the container system 100. For example, the complimentary connecting feature 330 may include at least one thread 332 or thread groove that is capable of mating with at least one thread 462 or thread groove on the closure 400. The complimentary connecting features 330 (e.g., threads and/or thread grooves 332) of the shroud 300 may be located on the outer surface 322 of the neck 310. The container system 100 may be closed by relatively rotating the closure 400 onto the neck 310 in a closing direction.

The neck 310 may terminate in a rim 314, which may define the shroud opening 340. The shroud opening 340 allows access to the interior volume 202 of the container body 200 through the container opening 222 when the shroud 300 is engaged with the container body 200.

The shroud opening 340 may be sized to allow an adult human hand to pass through to access the contents contained in the interior volume 202 of the container body 200. The shroud opening 340 may have a major axis 342 of a second length, as measured from the inner surface 312 of the neck 310 on one side of the neck 310 to the inner surface 312 on the opposite side. The shroud opening 340 may have a major axis 342 having a second length of from about 60 mm to about 150 mm, or from about 75 mm to about 120 mm, or from about 80 mm to about 100 mm, or from about 85 mm to about 90 mm. The shroud opening 340 may substantially circular, and the major axis 342 may be a diameter.

The shroud opening 340 may be smaller than the opening 222 of the container body 200. The second length may be less than the first length (i.e., the length of the major axis 224 of the container opening 222). A plane defined by the rim 220 of the container opening 222 may have a greater surface area than that of a plane defined by the rim 314 of the neck 310.

The shoulder of the shroud 300 may comprise an outer surface 322, which faces away from the container body 200 when the shroud 300 is engaged with the container body 200. The shoulder may further comprise an inner surface 323 oppositionally positioned to the outer surface 322, where the inner surface 323 faces towards the container body 200 when the shroud 300 is engaged with the container body 200.

The shoulder 320 of the shroud 300 may comprise an upper shoulder 324 and a lower shoulder 426. The upper shoulder 324 may extend peripherally from the neck 310 of the shroud 300. The upper shoulder 324 may be defined by a generally flat annular surface, which may be concentric with the center of the shroud opening 340. The upper shoulder 324 may substantially horizontal to the top wall 410 of the closure 400 when the closure 400 is in a closed position on the shroud 300. The upper shoulder 324 may have an outer periphery 325, which defines where the upper shoulder 324 meets, and is adjacent to, the lower shoulder 326. The outer periphery 325 may be configured to be substantially flush with the outer skirt 420 of the closure 400 when the closure 400 is in the closed position, which may provide a pleasing overall appearance due to the continuous character of the closure 400 and shroud 300.

The shroud 300 may comprise at least a first locking lug 350. The shroud 300 may comprise a second locking lug 360. The locking lugs 350, 360 may be located on the shoulder 320, typically the upper shoulder 324, of the shroud 300. The locking lugs 350, 360 may project axially upwardly from the outer surface 322 of the shoulder 320. The locking lug 350, 360 may be configured and positioned to engage the locking tab 480, 490 of the closure 400 when the closure 400 is in the closed position so that rotation of the closure 400 in an opening direction is prevented until at least one pressing pad 330, 340 on the closure 400 is pressed. In an opening or closing operation, the locking lugs of the shroud 300 are typically stationary.

The locking lugs 350, 360 may located on a radius that is substantially parallel to the major dimension 204 of the container.

The locking lugs 350, 360 may be found in other positions as well. For example, the locking lugs 350, 360 may project radially outward from the neck 310. As shown in FIG. 16, the neck of the shroud 300 or container body 200 may include at least one flange 316 that projects radially outward from the neck 310, and the locking lugs 350, 360 may be located on the flange 316. The neck 310 may comprise at least two flanges 316, including at least one for each locking lug 350, 360. The flange 316 may be an annular flange that partially or completely encircles the neck 310. The locking lugs 350, 360 may project axially upwardly from the flange(s) 316.

Each locking lug 350, 360 may include a locking face 352, 362, typically extending substantially along a radius of the shroud opening 340. The locking face 352, 362 of the shroud's locking lug 350, 360 may be configured to engage the tab locking face 486, 496 of the closure's locking tab 480, 490 and prevent rotation in the opening direction.

Each locking lug 350, 360 may include an outer surface 354, 364 positioned to face radially outwards from the neck 310. The outer surface 354, 364 of the lug 350, 360 may be flat, or it may be shaped in the form of a circular arc with a centerpoint corresponding to the center of the shroud opening 340.

Each locking lug 350, 360 may include an inner surface 356, 366 positioned to face radially inward towards the neck 310. At least a portion of the inner surface 356, 366 may be formed perpendicular to the locking face 352, 362. At least a portion of the inner surface 356, 366 may be angled to help to ensure that the locking tabs 480, 490 of the closure 400 will be deflected radially inward as they move past the locking lugs 350, 360 as the closure 400 is rotated in the closing direction. The inner surface 356, 366 may be formed on a parting line of the mold used to make the shroud 300.

The locking lug 350, 360 may be configured so that the locking tabs 480, 490 of the closure 400 will be deflected radially outward as the tabs 480, 490 move past the locking lugs 350, 360 as the closure 400 is rotated in a closing direction. The outer surface 354, 364 of the locking lug 350, 360 may be angled to facilitate the deflection.

To close the container system 100, whether the locking lugs 350, 360 are on the shroud 300 or on the container body 200, the closure 400 may be relatively rotated on the neck 310 in a closing direction, where the connecting feature 460 (e.g., threads 462) of the closure 400 engages and mates with the complimentary connecting feature 330 (e.g., thread grooves) of the shroud neck 310 or container body 200. As the closure 400 continues to rotate, the tab leading face 482, 492 of the closure 400 may contact the locking lugs 350, 360. Further rotation of the closure 400 results in the locking tab 480, 490 deflecting around the locking lug 350, 360 until the tab 480, 490 passes the lug 350, 360, at which point the tab 480, 490 may return or even snap back to its original (undeflected) position. At this point, the locking face 486, 496 of the locking tab 480, 490 may be engaged with the locking face 352, 362 of the locking lug 350, 360, and rotation in an opening direction is prevented until the push pads 430, 440 are pressed.

The closure 400 and/or shroud 300 may be configured so that when the locking tab 480, 490 returns to its original position, an audible signal such as a click is produced. An audible signal may be useful for communicating to the user that the container system 100 is closed and secure.

When the locking tab 480, 490 of the closure 400 is located radially inward to the push pad 430, 440, as shown in FIGS. 7 and 8, upon rotation in a closing direction, the locking tab 480, 490 of the closure 400 may be deflected inward around the locking lug 350, 360 until the tab 480, 490, such that the outer surface 485, 495 of the locking tab 480, 490 slides along the inner surface 356, 366 of the locking lug. As the locking tab 480, 490 slides along the locking lug's inner surface 356, 366, the locking lug 350, 360 may pass into and through the outer gap 464, 465 formed by the locking tab 480, 490 and the closure's outer skirt 420, or even the panel 432, 442 of the closure 400. Alternatively, upon rotation in a closing direction, the locking lug 350, 360 of the shroud 300 may cause the closure's locking tab 480, 490 to deflect radially outward, such that the inner surface 484, 494 of the locking tab 480, 490 slides along the outer surface 354, 364 of the locking lug 350, 360. In this case, the locking lug 350, 360 may pass into and through the inner gap 466, 467 between the locking tab 480, 490 and the inner skirt 470.

To disengage the closure 400 from the shroud 300, whether the locking lugs are on the shroud 300 or the container body 200, a user can place a finger, for example, on each pressing pad 430, 440, preferably with one hand, and press radially inward. When the pressing pads 430, 440 are pressed, the locking tabs 480, 490 may be radially displaced (either radially inward or outward, depending on the configuration of the closure 400) and disengage with the locking lugs 350, 360. When the closure 400 is relatively rotated in an opening direction with the push pads 430, 440 pressed, the locking tabs 480, 490 can slide past the locking lugs 350, 360. Once locking tabs 480, 490 are disengaged from the locking lugs 350, 360 and begin to slide past them, the push pads 430, 440 may no longer need to be depressed, and the closure 400 can be unscrewed in a known manner.

As shown in FIGS. 14-15, the lower shoulder 326 of the shroud 300 may extend axially downwardly and/or radially outward from the upper shoulder 324. The lower shoulder 326 may terminate at a lower edge 327. The lower edge 327 may be configured to be substantially flush with, or even embedded into, the container body 200 when the shroud 300 is connected to the container body 200. In addition to creating an aesthetically pleasing continuous appearance, such a configuration may make the container system 100 more secure, as it will be challenging to pry the shroud 300 off the container body 200, which would allow a user to bypass the squeeze-and-turn closure mechanism described above. The periphery of the lower edge may be substantially rectangular or substantially square.

Figure 17:
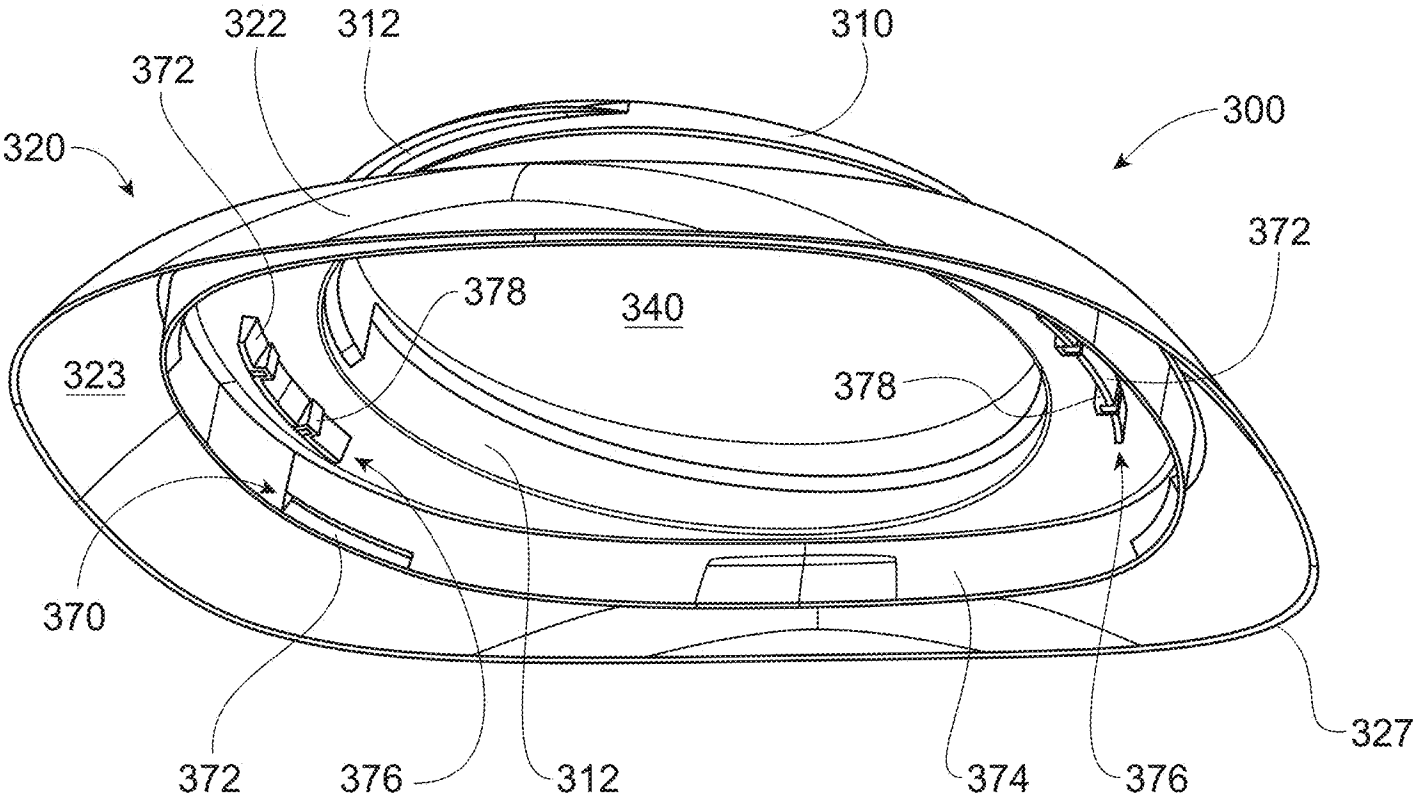
FIG. 17 shows a bottom perspective view of a shroud according to the present disclosure.

The shroud 300 may be connectably engageable with a container body 200. As shown in FIG. 17, the shroud 300 may include a body-connecting feature 370, such as a thread, a thread groove, a rib 372, or a bead. The body-connecting feature 370 is typically configured to connect to a container body 200, such as to the neck 230 of a container body 200. When the opening 222 of the container body 200 is in the shape of a circle, the body-connecting feature 370 may comprise threads or thread grooves that can be rotatably mated with a neck of the container body 200. When the opening 222 of the container body 200 is not in the shape of a circle, the body-connecting feature 370 may comprise a rib 372 or a bead, which may be snapped onto a corresponding rib or bead located on a neck of the container body 200.

The body-connecting feature 370 may be located on an inner skirt 374 of the shroud 300. The inner skirt 374 may depend axially downwardly from the inner surface 312 of the shroud 300. The inner skirt 374 may be substantially concentric with the opening 340, although it need not have the same general shape. The body-connecting feature 370 may project radially inward from an inner surface of the inner skirt 374. The body-connecting feature 370 may be continuous around the inner skirt 374, or it may be discontinuous. The body-connecting feature 370 may comprise a plurality of segments, such as two, three, or four segments. The segments may be located to correspond to certain walls or certain corners adjacent the opening 222 of the container body 200.

As seen in FIG. 17, the shroud 300 may comprise a stacking structure 376. The stacking structure 376 located on the inner surface 323 of the shroud 300 and may extend axially downwardly. The stacking structure 376 may be configured to engage with other shrouds 300, or with other closure systems 150 (e.g., a closure 400 engaged with another shroud). The stacking structure 376 can add stability when shrouds 300 and/or closure systems 150 are stacked, e.g., during storage before they are connected to the container bodies. The stacking structure 376 may comprise one or more stacking ribs 377, typically at least two stacking ribs, or even at least four stacking ribs. The stacking ribs 377 may be located on opposite sides of the shroud opening 340 to provide maximum stability. The stacking ribs 377 may comprise one or more projections 378 that extend radially, for example, radially inward towards the center axis of the shroud opening 340. The projections 378 may be sized and positioned to engage with features on another shroud 300 or on a closure 400. For example, the projections 378 on the stacking rib 377 may be configured to engage with irregularities 436, e.g., ribs, of the push pads 430, 440 of the closure 400.

Container Body

Figure 18:
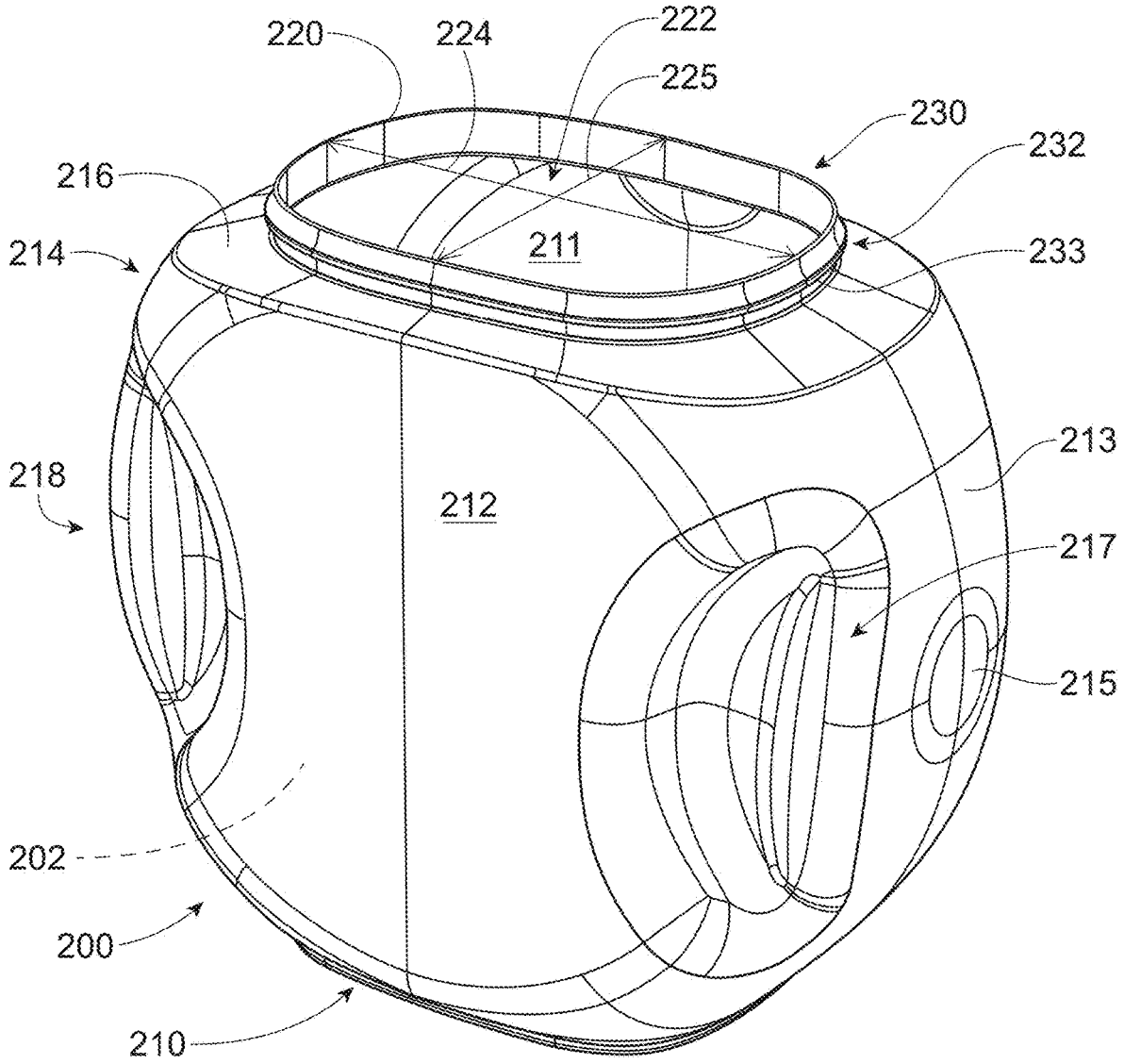
FIG. 18 shows a rear perspective view of a container body according to the present disclosure.
Figure 19:
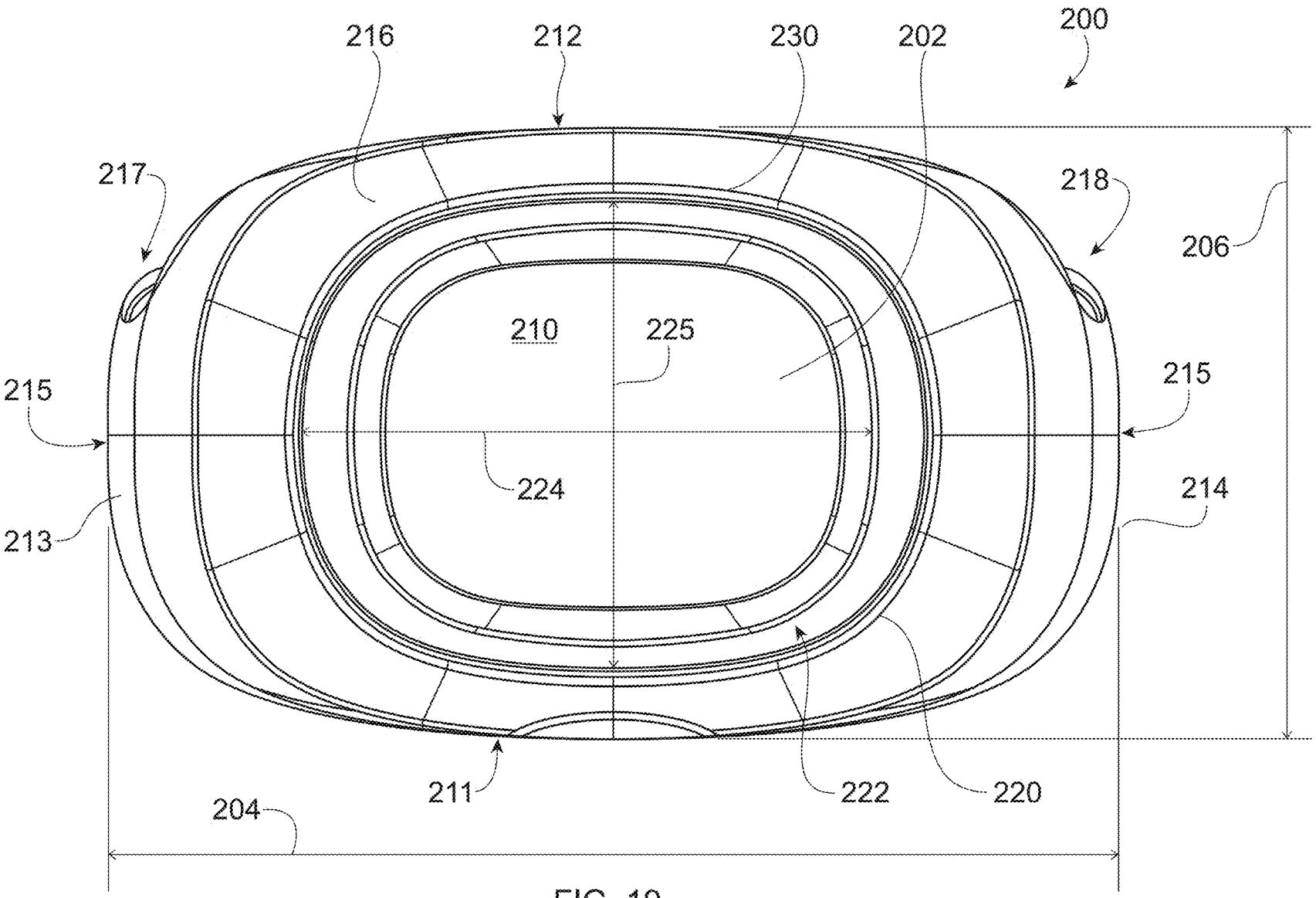
FIG. 19 shows a top view of a container body according to the present disclosure.
Figure 20:
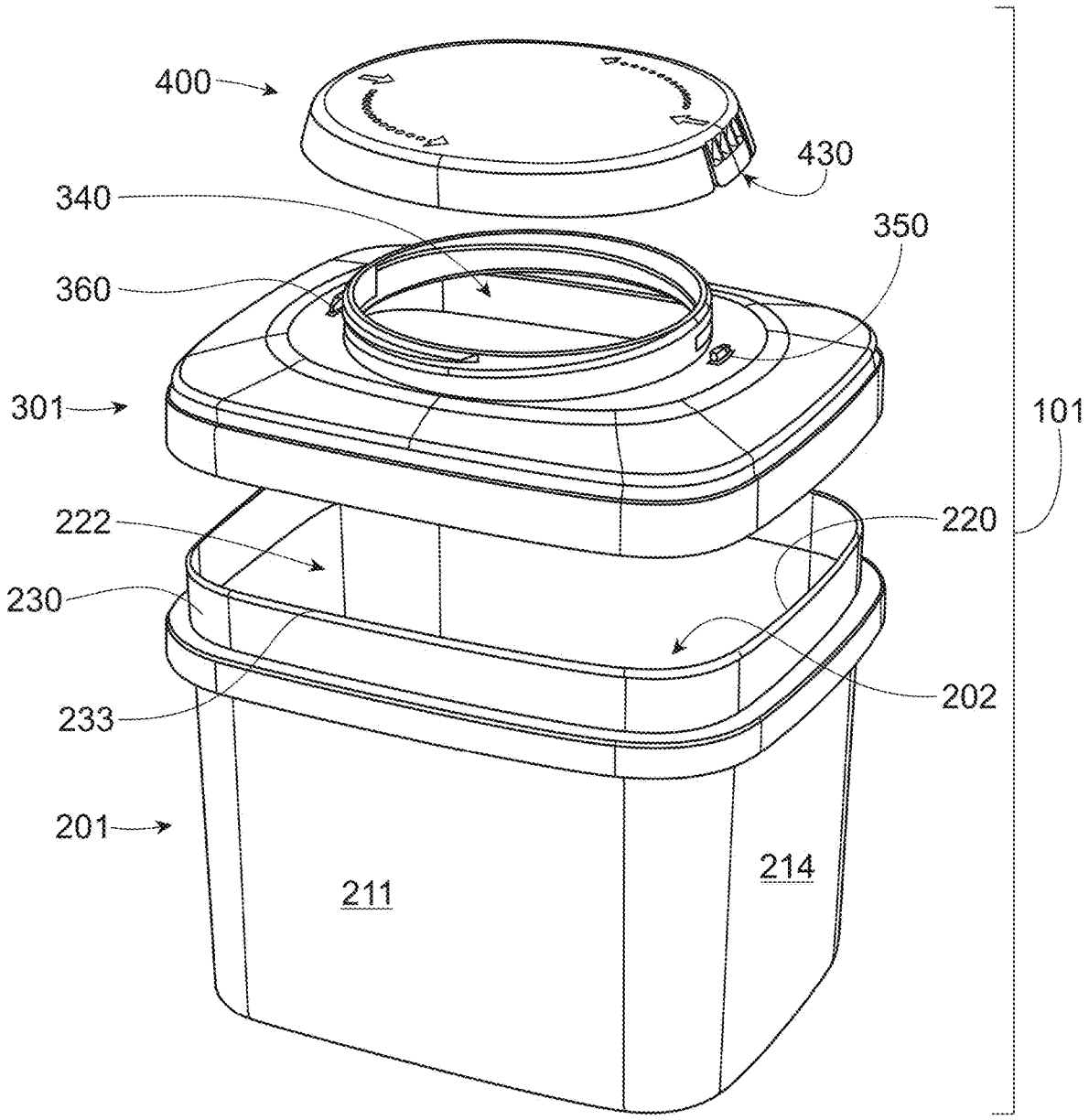
FIG. 20 shows a container system according to the present disclosure.

The container systems 100, 101 of the present disclosure may include a container body 200, as shown in FIGS. 18-20. The container body 200 may comprise walls that define an interior volume 202. The container body 200 may include a bottom wall 210, a front wall 211, a rear wall 212, and two side walls 213, 214. As shown in FIG. 18, the front wall 211 and rear wall 212 may be relative flat, and the two side walls 213, 214 may be relatively curved, providing a relatively rounded appearance when viewed from the front. See also FIG. 1. The curved side walls 213, 214 may include a flat portion 215, which can be useful to minimize wear-and-tear when two container bodies are touching during transport, storage, and/or display. The container body 200 may also include an upper wall 216.

The interior volume 202 may have a volume of at least about 0.5 L, or at least about 1 L, or at least about 2 L, or at least about 3 L, or at least about 4 L, or at least about 5 L, or at least about 6 L. The interior volume 202 may have a volume no more than about 100 L, or no more than about 50 L, or no more than about 10 L, or no more than about 8 L, or no more than about 6 L, or no more than about 5 L, or no more than about 4 L, or no more than about 2 L, or no more than about 1 L.

The container body 200 may include a rim 220 at an upper portion of the container body 200. The rim 220 may define a container opening 222. The container opening 222 allows access the interior volume 202.

As shown in FIG. 18, the container body 200 may include a container neck 230 that projects axially upwardly and away from the interior volume 202. The container neck 230 may project upwardly from an upper wall 216 of the container. The container neck 230 may terminate with the rim 220.

The container body 200 may include a shroud-connecting feature 232, which may facilitate connection of the container body 200 to the shroud 300. The shroud-connecting feature 232 may be located on the container neck 230, for example on an outer surface of the container neck 230. The shroud-connecting feature 232 may comprise a thread, a thread groove, a rib 233, or a bead. The shroud-connecting feature 232 may be configured to complimentarily mate with the body-connecting feature 370 of the shroud 300 so that the shroud 300 is securely fastened to the container body 200. The opening 222 of the container body 200 is typically axially aligned with the shroud opening 340 when the shroud 300 is connected to the container body 200.

The container body 200 may include handle portions 217, 218. The handle portions 217, 218 may be molded as part of the walls 212, 213, 214. Such handle portions 217, 218 are useful for picking up the container 200 or holding it with one hand while the other hand is used to rotate the closure 400. The container body 200 may include two handle portions 217, 218.

The container body 200 may include a groove configured to receive the lower edge of the shroud 300. Such a groove can improve the security of the container systems 100, 101 as the shroud 300/closure system 150 are more challenging to be pried off in an unintended manner.

As shown in FIG. 19, the container opening 222 may have a major axis 224 of a first length. The first length may be between from about from about 100 mm to about 200 mm, or from about 110 mm to about 150 mm, or about 120 mm. The length of the major axis 224 of the container opening 222 (first length) may be greater than the length of the major axis 342 of the shroud opening 340 (second length). In other words, the first length may be greater than the second length. The first length may be at least 10%, preferably at least 20%, greater than said second length. The ratio of the first length to the second length may be from about 2:1 to about 1:1, or about 4:3.

The closure's top wall 410 may have a major axis 415, for example line X-Y in FIG. 3, that has a fourth length. When the closure 400 is in a closed position, the major axis 415 of the closure's top wall 410 may be substantially parallel to the major axis 224 of the container opening 222. When the closure 400 is in a closed position, the major axis 424 of the lower periphery 423 of the closure 400 may be substantially parallel to the major axis 224 of the container opening 222.

The container 200 may have a major horizontal dimension 204, extending from one wall to an opposite wall in the horizontal plane when standing upright. The container may have a minor horizontal dimension 206, extending from one wall to an opposite wall in the horizontal plane when standing upright. The major dimension 204 is typically greater than the minor dimension 206. In the container shown in FIG. 19, for example, the major horizontal dimension 204 is from one side wall 213 to the other side wall 214, specifically as measured at the flat portions 215. In the same container, the minor horizontal dimension 206 is from the front wall 211 to the rear wall 212. Typically, when a container system 100 is displayed in a retail environment, it is desirable to present the container system 100 in such a way so that the consumer is most likely to view a wall that is parallel with the major dimension (here, the front wall 211, or less preferably the rear wall 212), as it tends to provide the most space for communication and/or artwork. When the closure 400 is in a closed position, the major axis 424 of the lower periphery 423 of the closure 400 may be substantially parallel to the major horizontal dimension 204 of the container body 200. The locking lugs 350, 360 may be located on a radius that is substantially parallel to the major dimension 204 of the container 200.

The container opening 222 may be substantially circular, in which case the major axis of the container opening 222 may be a diameter.

The container opening 222 may be non-circular. The container opening 222 may have a minor axis 206 of a third length. The third length may be from about from about 70 mm to about 120 mm, or from about 80 mm to about 100 mm, or about 90 mm. The third length may be less than the first length, greater than second length, or both. The first length may be at least 10% greater than the third length. The ratio of the first length to the third length may be from about 2:1 to about 1:1, or about 4:3.

The closure's lower periphery major axis 424 or the major axis 415 of the top wall 410 of the closure 400 (fourth length) may be greater than the minor axis 225 of the container opening 222 (third length). When either major axis 415, 424 of the closure 400 has a greater length than the minor axis 225 of the container opening 222, it may be easier to see when the closure 400 is not in a closed position due to misalignment.

The first length and/or third length may be at least two times, or at least three times, or at least four times greater than the width of an article 510 contained in the interior volume 202 of the container body 200. Typically, the greater the ratio of the major and/or minor axis 224, 225 to the size of the article 510, the more efficiently the container body 200 can be filled with the articles. The first length and/or third length may be up to twenty times, or up to fifteen times, or up to ten times greater than the width of an article contained in the interior volume 202 of the container body 200.

As shown in FIG. 20, the container body 201 of the container system 101 may have a substantially rectangular shape, and the front, rear, and side walls 211, 212, 213, 214 may all be relatively flat. In such a case, the shape of the shroud 300 may be adapted to connect to the container body 201. However, the same closure 400 may be able to be used on different shrouds 300, 301, so long as the shroud opening 340 and/or neck 310 are consistent across the different shrouds 300, 301. Compare, e.g., FIG. 1 and FIG. 20.

Compositions

The container systems 100 of the present disclosure may contain any suitable material or composition 500. Typical materials and compositions 500 include, but are not limited to, fabric care treatments, hard surface cleaners, soaps, shampoos, conditioning agents, pesticides, paint, solvents, industrial chemicals, industrial hardware (e.g., nails, screws, etc.), medicines, pills, food, and the like. The material may be water-sensitive material, meaning that the material has a tendency to dissolve or degrade when exposed to liquid water or water vapor.

Non-limiting examples of useful compositions 500 include light duty and heavy duty liquid detergent compositions, hard surface cleaning compositions, detergent gels commonly used for laundry, bleach and laundry additives, shampoos, body washes, and other personal care compositions. Compositions 500 may take the form of a liquid, gel, solid, a unitized dose article, or mixtures thereof. Liquid compositions may comprise a solid. Solids may include powder or agglomerates, such as micro-capsules, beads, noodles or one or more pearlized balls or mixtures thereof. Such a solid element may provide a technical benefit, through the wash or as a pre-treat, delayed or sequential release component; additionally or alternatively, it may provide an aesthetic effect.

In some aspects, the compositions 500 may comprise one or more of the following non-limiting list of ingredients: opacifier; antioxidant; fabric care benefit agent; detersive enzyme; deposition aid; rheology modifier; builder; bleaching agent; bleach precursor; bleach catalyst; chelant; perfume; whitening agent; pearlescent agent; enzyme stabilizing systems; scavenging agents including fixing agents for anionic dyes, complexing agents for anionic surfactants, and mixtures thereof; optical brighteners or fluorescers; soil release polymers; dispersants; suds suppressors; dyes; colorants; hydrotropes such as toluenesulfonates, cumenesulfonates and naphthalenesulfonates; color speckles; colored beads, spheres or extrudates; clay softening agents. Additionally or alternatively, the compositions 500 may comprise surfactants and/or solvent systems.

The composition 500 may be a flowable composition that can be scooped, such as a free-flowing granular or powdered composition. In such cases, the container system 100 may further comprise a scoop adapted to fit into the container system 100 and to scoop the scoopable composition.

The container systems 100 described herein are particularly useful for containing compositions 500 in the form of an article 510. The article 510 may be suitable to be grasped by an adult human hand. Such articles 510 may have an article width 512 of from about 10 mm to about 100 mm, or from about 20 mm to about 70 mm, or from about 35 mm to about 55 mm, or from about 40 mm to about 50 mm. If the article 510 is rectangular in shape, the article width 512 is measured as the greatest distance between two parallel sides. When an article 510 has a variable width, the article width 512 is the average of such widths. The article width 512 may be from about 5% to about 90% of said second length (i.e., major axis of the shroud opening 340). Such articles 510 may have a height, of from about 10 mm to about 100 mm, or from about 15 mm to about 70 mm, or from about 20 mm to about 50 mm, or from about 25 mm to about 35 mm. When an article 510 has a variable height, the article height is measured at the maximum height of the article.

Figure 21:
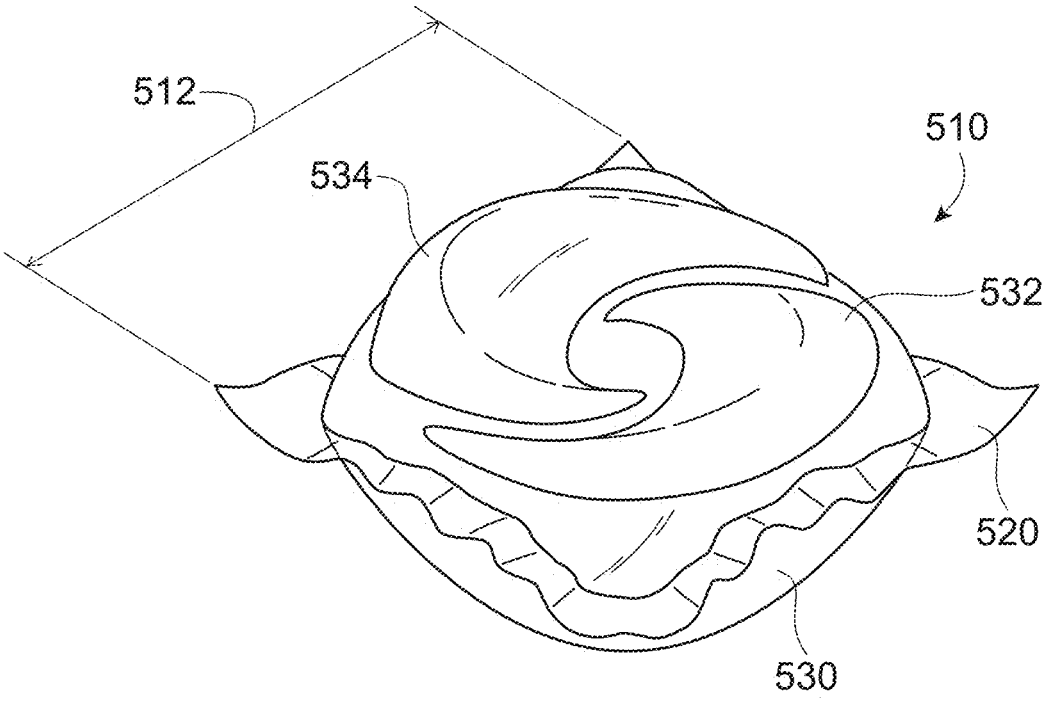
FIG. 21 shows a unitized dose article according to the present disclosure.

Typically, the container systems 100 described herein are useful for containing articles 510 of unitized doses of a composition (e.g., in counts of 50, 66, 77, etc.), typically of a cleaning composition, more typically of a laundry detergent or hard surface treatment composition. FIG. 21 shows an example of a unitized dose article 510. The unitized dose article 510 may be a pouch. The pouch may be formed from a water-soluble film 520, such as a polyvinyl alcohol film, including those available from MonoSol, LLC. The film 520 may encapsulate the composition 500 in a compartment. The pouch may comprise a single compartment, or it or may comprise multiple compartments 530, 532, 534. The pouch may contain various compositions, which may be of varying colors that may be seen from outside of the pouch. A multi-compartment pouch may contain the same or different compositions in each separate compartment. The compartments may be side-by-side or superposed, for example one or two smaller compartments 532, 534 superposed on one larger compartment 530. This multi-compartment feature may be utilized to keep compositions containing incompatible ingredients (e.g., bleach and enzymes) physically separated or partitioned from each other. It is believed that such partitioning may expand the useful life and/or decrease physical instability of such ingredients.

The compositions 500 of the unitized dose articles 510 typically have low levels of water. In some aspects, the compositions 500 comprise less than about 50%, or less than about 30%, or less than about 20%, or less than about 15%, or less than about 12%, or less than about 10%, or less than about 8%, or less than 5%, or less than 2% water by weight of the composition 500. In some aspects, the composition 500 comprises from about 0.1% to about 20%, or from about 1% to about 12%, or from about 5% to about 10% water by weight of the composition 500.

Two-Piece Container Systems

As shown in FIG. 2, the present disclosure relates to container systems 100 having a container body 200 and a closure 400. The container body 200 may contain compositions 500, such as unitized dose articles 510, which may be water soluble. The compositions 500 may have a certain minimum size. The container systems 100 may comprise two pieces and may not include a shroud 300.

The container body 200 may include walls 210, 211, 212, 213, 214 that define an interior volume 202. The container body 200 may also comprise a rim 220 that defines a container opening 222. The container opening 222 allows access to the interior volume 202. The container opening 222 is sized to be capable of receiving an adult human hand. Additional characteristics of suitable containers are described above. The container is configured to receive the closure 400, for example with threads 332 or thread grooves on a neck 230, which may terminate in the rim 220 that defines the opening 222.

The container may include a first locking lug 350 and optionally a second locking lug 360. The first and second locking lugs 350, 360 may be located near the rim 220 and circumferentially spaced around a central axis. The locking lugs 350, 360 may be located on an upper wall 216 of the container. Additional characteristics of suitable locking lugs 350, 360 are described above.

The closures 400 of the two-piece container systems 100 may be squeeze-and-turn closures. The closure 400 may be configured to be connectably engageable with the container body 200 to close the container opening 222 when the closure 400 is engaged with the container body 200 in a closed position. The closure 400 may comprise a top wall 410 and an outer skirt 420 depending downwardly from said top wall 410 toward the container body 200 when the closure 400 is in the closed position. The outer skirt 420 may comprise a first push pad 430 and optionally a second push pad 440, which may be circumferentially spaced from the first push pad 430. The closure 400 may further comprise a first locking tab 480 that engages the first locking lug 350 when the closure 400 is in the closed position. The closure 400 may further comprise a second locking tab 490 that engages the second locking lug 360 when the closure 400 is in the closed position. The engagement of the locking tabs 480, 490 with the locking lugs 350, 360 prevents rotation of the closure 400 in the opening direction; however, pressing the push pads 330, 340 radially inward causes the locking tabs to disengage from the locking lugs, allowing the closure 400 to be rotated in the opening direction. The closure's top wall 410 may have a major axis 415 having a length of from about 70 mm to 130 mm, or from about 80 mm to about 120 mm, or from about 90 mm to about 110 mm, or from about 95 mm to about 105 mm, or about 100 mm.

The closure 400 may have a height 452 as described above. The ratio of the length of the major axis 415 to the height 452 may be from about 2:1 to about 20:1. Further details on suitable closures 400 are provided above.

The container 200 may include water-soluble unit dose articles 510. The articles 510 may comprise a water-soluble film 520 that encapsulates a composition 500, preferably a household care composition, in at least one compartment 530, 532, 534. The soluble unit dose articles may have an average volume of from about 5 mL to about 80 mL, preferably from about 15 mL to about 50 mL. Further details on suitable articles 510 are provided above.

Closure Systems

Figure 22:
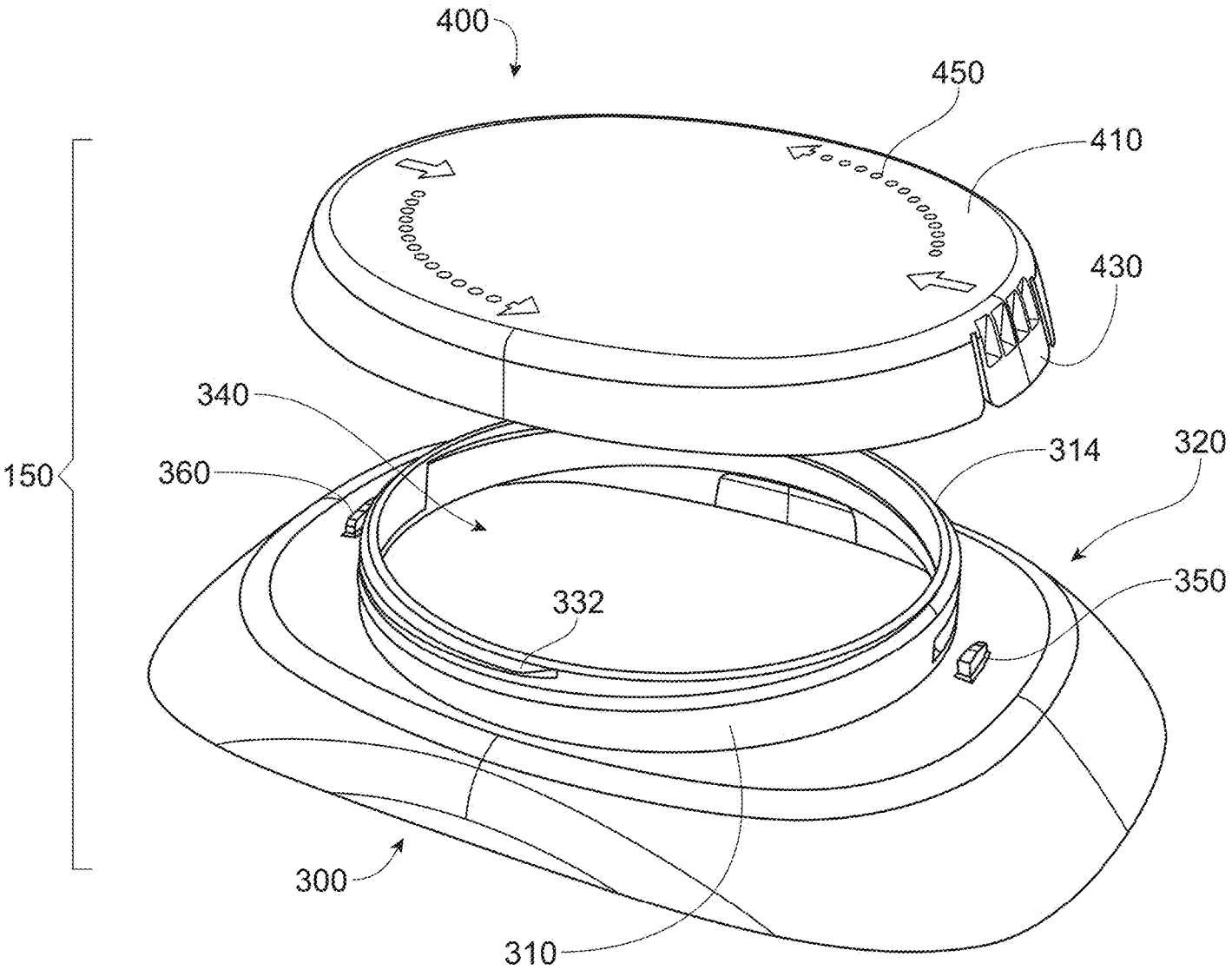
FIG. 22 shows a closure system according to the present disclosure.

The present disclosure relates to closure systems 150 that may include a shroud 300 and a squeeze-and-turn closure 400 as described herein. The closure systems 150 are configured to be connectably engageable with a container body 200, or even a variety of container bodies. FIG. 22 shows a closure system 150 according to the present disclosure.

The closure system 150 may include a shroud 300 as described herein. The shroud 300 may be configured to be connectably engageable with a container body 200. The shroud 300 may be configured to be connectably engageable with at least two different container bodies, each container body 200 having a different interior volume 202. The shroud 300 may comprise a shroud opening 340. The shroud opening 340 may be sized to be capable of receiving an adult human hand. The shroud 300 may include at least a first locking lug 350. Further details on suitable shrouds 300 are provided above.

The closure system 150 may also include a closure 400. The closure 400 may be configured to be rotatably connectably engageable with the shroud 300 to close the shroud opening 340 when the closure 400 is engaged with the shroud 300 in a closed position. The closure 400 may include a top wall 410 and an outer skirt 420 depending downwardly from the top wall 410 toward the shroud 300 when the closure 400 is in the closed position. The outer skirt 420 may include a first push pad 430. When the closure 400 is in the closed position, the closure 400 is prevented from being rotated in an opening direction until the first push pad 430 is pressed radially inward. The outer skirt 420 may further comprise a second push pad 440, which may be circumferentially spaced from the first push pad 430. The closure 400 may comprise a first locking tab 480 that engages the first locking lug 350 when the closure 400 is in the closed position to prevent rotation of the closure 400 in the opening direction, and where pressing the first push pad 430 radially inward causes the first locking tab 480 to disengage with the first locking lug 350. Further details on suitable closures 400 are provided above.

Method of Filling a Container System

The present disclosure relates to a method of filling a container system 100 with a composition 500. The method may comprise the steps of: providing a container body 200 having an interior volume 202; providing a composition 500 preferably a composition 500 in the form of unitized dose articles, to the interior volume 202 of the container; and providing a shroud 300 and a squeeze-and-turn closure 400 to the container body 200. The shroud 300 and closure 400 may be provided to the container body 200 as a single closure system 150. Alternatively, the shroud 300 and closure 400 may be provided in two steps.

The container body 200 may comprise walls defining an interior volume 202. The container body 200 may further comprise a rim defining a container opening 222 that allows access to said interior volume 202. The container opening 222 may have a major axis 224 of a first length.

The shroud 300 may be configured to be connectably engageable with the container body 200. The shroud 300 may comprise a shroud opening 340 that allows access to the interior volume 202 through the container opening 222 when the shroud 300 is engaged with the container body 200. The shroud opening 340 may have a major axis 342 of a second length. The second length may be less than the first length.

The closure 400 may be configured to be rotatably connectably engageable with the shroud 300 to close the shroud opening 340 when the closure 400 is engaged with the shroud 300 in a closed position. The closure 400 may comprise a top wall 410 and an outer skirt 420 depending downwardly from said top wall 410 toward the shroud 300 when the closure 400 is in the closed position. The outer skirt 420 may comprise a first push pad 430. When the closure 400 is in the closed position, the closure 400 is prevented from being rotated in an opening direction until the first push pad 430 is pressed radially inward.

The closure systems 150 and container bodies 200 of the present disclosure may be formed separately (for example by separate suppliers), then brought together for filling and assembly.

The method may further comprise the step of shaking or vibrating the container systems 100 or a portion thereof while they are being filled and/or once they are filled with the unitized doses, which can reduce the volume occupied within the container bodies and settle the contents, such as unitized dose articles 510.

More details on container systems 100, container bodies, shrouds 300, closures 400, and compositions 500, such as unit dose articles 510, suitable for the methods described herein are provided above.

Combinations

Specifically contemplated combinations of the disclosure are herein described in the following lettered paragraphs. These combinations are intended to be illustrative in nature and are not intended to be limiting.

A. A container system 100 comprising: (a) a container body 200 comprising walls 210, 211, 212, 213, 214 defining an interior volume 202, and a rim 220 defining a container opening 222 that allows access to said interior volume 202, wherein said container opening 222 has a major axis 224 of a first length; (b) a shroud 300 that is configured to be connectably engageable with said container body 200, said shroud 300 comprising a shroud opening 340 that allows access to said interior volume 202 through said container opening 222 when said shroud 300 is engaged with said container body 200, wherein said shroud opening 340 has a major axis 342 of a second length, said second length being less than said first length; and (c) a closure 400 that is configured to be rotatably connectably engageable with said shroud 300 to close said shroud opening 340 when said closure 400 is engaged with said shroud 300 in a closed position, said closure 400 comprising a top wall 410, an outer skirt 420 depending downwardly from said top wall 410 toward said shroud 300 when said closure 400 is in said closed position, said outer skirt 420 comprising a first push pad 430, wherein when said closure 400 is in said closed position, said closure 400 is prevented from being rotated in an opening direction until said first push pad 430 is pressed radially inward.

B. A container system 100 according to paragraph A, wherein said skirt 420 further comprises a second push pad 440, and wherein said closure 400 is prevented from being rotated in an opening direction until said second push pad 440 is pressed radially inward, preferably at the same time as when the first push pad 430 is pressed radially inward.

C. A container system 100 according to any of paragraphs A-B, wherein said first and second push pads 430, 440 are circumferentially spaced apart by from about 45° to about 180°, preferably from about 90° to about 180°, more preferably about 180°.

D. A container system 100 according to any of paragraphs A-C, wherein the shroud 300 comprises a first locking lug 350, and wherein said closure 400 comprises a first locking tab 480 that engages said first locking lug 350 when said closure 400 is in said closed position to prevent rotation of said closure 400 in said opening direction, and wherein pressing said first push pad 430 radially inward causes said first locking tab 480 to disengage with said first locking lug 350.

E. A container system 100 according to any of paragraphs A-D, wherein said first locking tab 480 is located in substantially radial alignment with said first push pad 430.

F. A container system 100 according to any of paragraphs A-E, wherein said first locking tab 480 is located radially inward from said first push pad 430.

G. A container system 100 according to any of paragraphs A-F, wherein said first locking tab 480 flexes radially inward when said first push pad 430 is pressed radially inward.

H. A container system 100 according to any of paragraphs A-G, wherein said first locking tab 480 is circumferentially spaced away from said first push pad 430.

I. A container system 100 according to any of paragraphs A-H, wherein said first locking tab 480 flexes radially outward when at least said first push pad 430 is pressed radially inward.

J. A container system 100 according to any of paragraphs A-I, wherein said first push pad 430 comprises a panel 432 formed by at least one slot 434 in said outer skirt, preferably two slots 434, 435.

K. A container system 100 according to any of paragraphs A-J, wherein said slot 434, 435 is a longitudinal slot extending from a lower edge 422 of said outer skirt 420 toward said top wall 410.

L. A container system 100 according to any of paragraphs A-K, wherein said shroud 300 further comprises a second locking lug 360, and where said closure 400 comprises a second locking tab 490 that engages said second locking lug 360 when said closure 400 is in said closed position to prevent rotation of said closure 400 in said opening direction.

M. A container system 100 according to any of paragraphs A-L, wherein said first length is at least 10%, preferably at least 20%, greater than said second length.

N. A container system 100 according to any of paragraphs A-M, wherein said container opening 222 further has a minor axis 225 of a third length, wherein said first length is at least 10% greater than said third length.

O. A container system 100 according to any of paragraphs A-N, wherein a plane defined by said rim 220 of said container opening 222 has a greater surface area than a plane defined by a rim of said shroud opening 340.

P. A container system 100 according to any of paragraphs A-O, wherein said top wall 410 of said closure 400 has a major axis 415 of a fourth length, wherein said major axis 415 of said closure's top wall 410 is substantially parallel to said major axis 224 of said container opening 222 when said closure 400 is in said closed position, preferably wherein said fourth length is greater than said third length.

Q. A container system 100 according to any of paragraphs A-P, wherein said closure 400 has a height 452 that is at least 50% less, preferably at least 75% less, than said fourth length of said major axis 415 of said top wall of said closure 400.

R. A container system 100 according to any of paragraphs A-Q, wherein a span length 427, as measured from the middle of the first push pad 430, to the nearest outer edge of the top wall, across the top wall to the opposite outer edge to the middle of the second push pad 440, is from about 50 mm, or from about 70 mm, or from about 90 mm, or from about 105 mm, to about 150 mm, or to about 130 mm, or to about 120 mm, or to about 115 m or to about 110 mm.

S. A container system 100 according to any of paragraphs A-R, wherein said interior volume 202 of said container body 200 comprises a composition 500, preferably a composition 500 in the form of articles 510, more preferably articles 510 sized to fit in an adult human hand.

T. A container system 100 according to paragraph S, wherein the articles 510 are water-soluble unitized dose articles that comprise household care composition.

U. A container system 100 according to any of paragraphs S-T, wherein the articles 510 have an article width, wherein the article width is from about 5% to about 90% of said second length.

V. A container system 100 according to any of paragraphs A-S, wherein the composition 500 is a flowable composition, preferably wherein said container system 100 further comprises a scoop.

W. A container system 100 according to any of paragraphs A-V, wherein said shroud 300 comprises a neck 310 encircling said shroud opening 340.

X. A container system 100 according to any of paragraphs A-W, wherein said closure 400 further comprises an inner skirt 470 positioned radially inward to said outer skirt 420, said inner skirt 470 comprising a connecting feature 460, preferably at least one thread 462, that engages with a complimentary connecting feature 330 on the shroud 300, preferably on a neck 310 of the shroud 300.

Y. A container system 100 according to any of paragraphs A-X, wherein the connecting feature 460 on the inner skirt 470 and the complimentary connecting feature 330 on the shroud 300 are configured to allow the closure 400 to be removable from the shroud 300 upon rotating the closure 400 from said closed position in an opening direction by not more than about 180°, preferably by not more than about 135°, more preferably by not more than about 90°.

Z. A container system 100 according to any of paragraphs A-Y, wherein when said closure 400 is rotated in a closing direction, said container system 100 produces an audible signal, preferably produced by a locking tab 480, 490 returning to its original position, when the closure 400 is in said closed position.

AA. A method of filling a container system 100 with a composition 500, said method comprising the steps of: providing a container body 200, wherein said container body 200 comprises walls 210, 211, 212, 213, 214 defining an interior volume 202, said container body 200 further comprising a rim 220 defining a container opening 222 that allows access to said interior volume 202, wherein said container opening 222 has a major axis 224 of a first length; providing a composition 500, preferably a composition 500 in the form of unitized dose articles 510, to said interior volume 202 of said container; providing a shroud 300 and closure 400 to said container body 200, wherein said shroud 300 is configured to be connectably engageable with said container body 200, said shroud 300 comprising a shroud opening 340 that allows access to said interior volume 202 through said container opening 222 when said shroud 300 is engaged with said container body 200, wherein said shroud opening 340 has a major axis 342 of a second length, said second length being less than said first length; and wherein said closure 400 is configured to be rotatably connectably engageable with said shroud 300 to close said shroud opening 340 when said closure 400 is engaged with said shroud 300 in a closed position, said closure 400 comprising a top wall 410, an outer skirt 420 depending downwardly from said top wall toward said shroud 300 when said closure 400 is in said closed position, said outer skirt 420 comprising a first push pad 430, wherein when said closure 400 is in said closed position, said closure 400 is prevented from being rotated in an opening direction until said first push pad 430 is pressed radially inward; the closure 400 may be a closure 400 according to any of paragraphs A-Z.

BB. A closure system 150 comprising: (a) a shroud 300 that is configured to be connectably engageable with a container body 200, said shroud 300 comprising a shroud opening 340 sized to be capable of receiving an adult human hand; and (b) a closure 400 that is configured to be rotatably connectably engageable with said shroud 300 to close said shroud opening 340 when said closure 400 is engaged with said shroud 300 in a closed position, said closure 400 comprising a top wall 410, an outer skirt 420 depending downwardly from said top wall 410 toward said shroud 300 when said closure 400 is in said closed position, said outer skirt 420 comprising a first push pad 430, wherein when said closure 400 is in said closed position, said closure 400 is prevented from being rotated in an opening direction until said first push pad 430 is pressed radially inward; the closure 400 may be according to any of paragraphs A-Z.

CC. A closure system 150 according to paragraph BB, wherein said outer skirt 420 further comprises a second push pad 440 circumferentially spaced from said first push pad 430.

DD. A closure system 150 according to any of paragraphs BB-CC, wherein the shroud 300 comprises a first locking lug 350, and wherein said closure 400 comprises a first locking tab 480 that engages said first locking lug 350 when said closure 400 is in said closed position to prevent rotation of said closure 400 in said opening direction, and wherein pressing said first push pad 430 radially inward causes said first locking tab 480 to disengage with said first locking lug 350.

EE. A closure 400 system according to any of paragraphs BB-DD, wherein said shroud 300 is configured to be connectably engageable with at least two different container bodies, each container body 200 having a different interior volume 202.

FF. A container system 100 comprising: (a) a container body 200 comprising bottom and side walls 210, 211, 212, 213, 214 defining an interior volume 202, a rim 220 defining a container opening 222 that allows access to said interior volume 202, wherein said container opening 222 is sized to be capable of receiving an adult human hand, and a first locking lug 350 and a second locking lug 360, said first and second locking lugs 350, 360 being located near the rim 220 and circumferentially spaced around a rotational axis RA; (b) a closure 400 configured to be connectably engageable with said container body 200 to close said container opening 222 when said closure 400 is engaged with said container body 200 in a closed position, said closure 400 comprising a top wall 410, an outer skirt 420 depending downwardly from said top wall 410 toward said container body 200 when said closure 400 is in said closed position, said outer skirt 420 comprising a first push pad 430 and a second push pad 440 circumferentially spaced from said first push pad 430, a first locking tab 480 that engages said first locking lug 350 when said closure 400 in said closed position, a second locking tab 490 that engages said second locking lug 360 when said closure 400 in said closed position, wherein said engagement of said locking tabs with said locking lugs prevents rotation of said closure 400 in said opening direction, and wherein pressing said push pads 430, 440 radially inward causes said locking tabs 480, 490 to disengage from said locking lugs 350, 360, allowing said closure 400 to be rotated in said opening direction; (c) soluble unit dose articles 510, said articles comprising a water-soluble film 520 that encapsulates a composition 500, preferably a household care composition, in at least one compartment 530, 532, 534; the closure 400 may be according to any of paragraphs A-Z.

GG. A container system 100 according to any of paragraphs FF, wherein the top wall 410 of the closure 400 has a major axis having a length of from about 70 mm to 130 mm, or from about 80 mm to about 120 mm, or from about 90 mm to about 110 mm, or from about 95 mm to about 105 mm, or about 100 mm.

HH. A container system 100 according to any of paragraphs FF-GG, wherein the closure 400 has a height 452, and wherein the ratio of the length of the major axis 415 of the top wall 410 of the closure 400 to the height 452 is from about 2:1 to about 20:1.

II. A container system 100 according to any of paragraphs FF-HH, wherein the soluble unit dose articles 510 have an average volume of from about 5 mL to about 80 mL, preferably from about 15 mL to about 50 mL.

JJ. A closure according to any of paragraphs A-II, wherein the closure is characterized by at least one of the following:

a) the major axis 415 of the top wall 410 has a length of from about 70 mm to 130 mm, or from about 80 mm to about 120 mm, or from about 90 mm to about 110 mm, or from about 95 mm to about 105 mm, or about 100 mm;

b) the minor axis 416 of the top wall 410 has a length of from about 50 mm to about 120 mm, or from about 70 mm to about 110 mm, or from about 80 mm to about 100 mm, or about 90 mm.

c) the ratio of the major axis 415 to the minor axis 416 of the top wall 410 is from about 2:1, or from about 1.5:1, or from about 1.3:1, or from about 1.2:1, or from about 1.15:1, to about 1:1;

d) the height 452 of the closure is from about 5 mm to about 50 mm, or from 7 mm to about 30 mm, or from about 8 mm to about 25 mm, or from about 10 mm to about 20 mm;

e) the ratio of closure height 452 to the major axis 415 of the closure's top wall 410 is from about 10:1 to about 1:15, or from about 5:1 to about 1:12, or from about 1:1 to about 1:10, or from about 1:5 to about 1:10, or from about 1:8 to about 1:10;

f) the span length 427 is from about 50 mm, or from about 70 mm, or from about 90 mm, or from about 105 mm, to about 150 mm, or to about 130 mm, or to about 120 mm, or to about 115 mm or to about 110 mm; or g) any combination of a)-f).

EXAMPLES

Example 1

A three-piece container system is provided with a closure with two push pads, a shroud, and a container body with molded handles. The top wall of the closure has a major axis of length of about 10 cm and a minor axis of a length of about 9 cm. The height of the closure is about 1 cm. The span length of the closure is from about 11 cm. The shroud has a circular shroud opening having a diameter/major axis length of about 9 cm. The opening of the container body has a major axis of length about 12 cm and a minor axis of length of about 9 cm. The container body has a major dimension of about 21 cm and a minor dimension of about 11 cm. The container system includes unitized dose articles containing laundry detergent, such as those sold under the trade name of TIDE PODS (available from The Procter & Gamble Company).

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A container system comprising:

a) a container body comprising walls defining an interior volume, and a rim defining a container opening that allows access to said interior volume, wherein said container opening has a major axis of a first length;

b) a shroud that is configured to be connectably engageable with said container body, said shroud comprising a shroud opening that allows access to said interior volume through said container opening when said shroud is engaged with said container body, wherein said shroud opening has a major axis of a second length, said second length being less than said first length, wherein said shroud opening is sized to allow an adult human hand to pass through to access said interior volume, wherein the shroud further comprises a first locking lug; and c) a closure that is configured to be rotatably connectably engageable with said shroud to close said shroud opening when said closure is engaged with said shroud in a closed position, said closure comprising a top wall, wherein said top wall of said closure has a major axis of a fourth length, wherein said major axis of said closure's top wall is substantially parallel to said major axis of said container opening when said closure is in said closed position, an outer skirt depending downwardly from said top wall toward said shroud when said closure is in said closed position, said outer skirt comprising a first push pad and a second push pad, wherein when said closure is in said closed position, said closure is prevented from being rotated in an opening direction until said first push pad and said second push pad are each pressed radially inward at the same time, wherein said closure comprises a first locking tab that engages said first locking lug of said shroud when said closure is in said closed position to prevent rotation of said closure in said opening direction, wherein said first locking tab is located radially inward from said first push pad, wherein said first locking tab flexes radially inward when said first push pad is pressed radially inward, and wherein pressing said first push pad radially inward causes said first locking tab to disengage with said first locking lug, wherein said closure further comprises an outer gap between an outer surface of the first locking tab and the outer skirt, the closure configured so that the first locking lug passes through the outer gap when the closure is rotated in an opening direction, wherein said closure has a height that is about 8 mm to about 25 mm, and wherein the ratio of the closure height to the fourth length of the major axis of the top wall is from about 1:5 to about 1:10, the closure being characterized by a span length of from about 50 mm to about 130 mm, wherein said span length is measured from the middle of the first push pad, to the nearest outer edge of the top wall, across the top wall to the opposite outer edge to the middle of the second push pad.

2. A container system according to claim 1, wherein said first and second push pads are circumferentially spaced apart by from about 45° to about 180°.

3. A container system according to claim 1, wherein said first locking tab is in substantially radial alignment with said first push pad.

4. A container system according to claim 1, wherein said first locking tab is circumferentially spaced away from said first push pad.

5. A container system according to claim 1, wherein said first push pad comprises a panel formed by at least one slot in said outer skirt.

6. A container system according to claim 5, wherein said slot is a longitudinal slot extending from a lower edge of said outer skirt toward said top wall.

7. A container system according to claim 1, wherein said shroud further comprises a second locking lug, and where said closure comprises a second locking tab that engages said second locking lug when said closure is in said closed position to prevent rotation of said closure in said opening direction.

8. A container system according to claim 1, wherein said first length is at least 10%, preferably at least 20%, greater than said second length.

9. A container system according to claim 1, wherein said container opening further has a minor axis of a third length, wherein said first length is at least 10% greater than said third length.

10. A container system according to claim 1, wherein a plane defined by said rim of said container opening has a greater surface area than a plane defined by a rim of said shroud opening.

11. A container system according to claim 1, wherein said interior volume of said container body comprises a composition.

12. A container system according to claim 11, wherein the composition is in the form of articles, where the articles are water-soluble unitized dose articles, and where the composition is a household care composition.

13. A container system according to claim 11, wherein the articles have an article width, wherein the article width is from about 5% to about 90% of said second length.

14. A container system according to claim 11, wherein composition is a flowable composition.

15. A container system according to claim 1, wherein said shroud comprises a neck encircling said shroud opening.

16. A container system according to claim 1, wherein said closure further comprises an inner skirt positioned radially inward to said outer skirt, said inner skirt comprising a connecting feature that engages with a complimentary connecting feature on the shroud.

17. A container system according to claim 16, wherein the connecting feature on the inner skirt and the complimentary connecting feature on the shroud are configured to allow the closure to be removable from the shroud upon rotating the closure from said closed position in an opening direction by not more than about 180°.

18. A container system according to claim 1, wherein when said closure is rotated in a closing direction, said container system produces an audible signal when the closure is in said closed position.

19. A closure according to claim 1, wherein the closure is characterized by at least one of the following:

a) the major axis of the top wall has a length of from about 80 mm to about 120 mm;

b) the minor axis of the top wall has a length of from about 50 mm to about 120 mm;

c) the ratio of the major axis to the minor axis of the top wall is from about 2:1 to about 1:1;

d) the height of the closure is from about 10 mm to about 20 mm;

e) the ratio of closure height to the major axis of the closure's top wall is from about 1:8 to about 1:10;

f) the span length is from 50 mm to about 130 mm; or g) any combination of a)-f).

20. The container system according to claim 1, wherein the closure further comprises an inner gap between an inner surface of the first locking tab and the inner skirt of the closure, wherein the closure is configured so that the first locking lug passes through the inner gap when the closure is rotated in a closing direction.

* * * * *